US005604040A

United States Patent [19]

Sugama

[11] Patent Number: 5,604,040

[45] Date of Patent: Feb. 18, 1997

[54] ZINC PHOSPHATE CONVERSION COATINGS

[75] Inventor: Toshifumi Sugama, Wading River, N.Y.

[73] Assignee: Associated Universities, Inc., Washington, D.C.

[21] Appl. No.: 565,902

[22] Filed: Dec. 1, 1995

Related U.S. Application Data

[63] Continuation of Ser. No. 160,230, Dec. 2, 1993, abandoned, which is a continuation-in-part of Ser. No. 944,230, Sep. 14, 1992, abandoned, which is a continuation-in-part of Ser. No. 743,278, Aug. 9, 1991, abandoned.

[51] Int. Cl.[6] ..... C23C 22/12

[52] U.S. Cl. ..... 428/472.3; 148/262; 148/251

[58] Field of Search ..... 148/251, 262; 428/472.3

[56] References Cited

U.S. PATENT DOCUMENTS

| | | | |
|---|---|---|---|
| 3,558,442 | 1/1971 | Roehl et al. | 204/28 |
| 4,659,395 | 4/1987 | Sugama et al. | 148/6.15 Z |

OTHER PUBLICATIONS

Lenz, et al., *J. Polymer Sci.*, vol. 58, pp. 351–367 (1962).
Kojima, et al., *Tetsu to Hagane*, vol. 66, pp. 924–934, (1980) [in Japanese].
Leidheiser, et al., *J. Electrochemical Society*, vol. 128, pp. 241–249, (Feb. 1981).
Sugama, et al., *J. Materials Sci.*, vol. 19, pp. 4045–4056, (1984).
Sugama, et al., *J. Materials Sci.*, vol. 19, pp. 4045–4056, (1984).
Sommer, et al., *Corrosion*, vol. 43, pp. 661–665, (1987).
Sugama, et al., *J. Materials Sci.*, vol. 22, pp. 722–736, (1987).
Sugama, et al., *J. Materials Sci.*, vol. 23, pp. 101–110, (1988).
Sugama, et al., *J. Coatings Tech.*, vol. 61, pp. 43–57, (Apr. 1989).
Sugama, et al., *J. Materials Sci.*, vol. 26, pp. 1045–1050, (1991).
Sugama, et al., *Materials and Manufacturing Processes*, vol. 6, pp. 227–239, (1991).
Sugama, et al., *Surface and Coatings Tech.*, vol. 50, pp. 89–95, (1992).
Sugama, et al., *J. Applied Polymer Sci.*, vol. 45, pp. 1291–1301, (1992).

*Primary Examiner*—Sam Silverberg
*Attorney, Agent, or Firm*—Margaret C. Bogosian

[57] ABSTRACT

Zinc phosphate conversion coatings for producing metals which exhibit enhanced corrosion prevention characteristics are prepared by the addition of a transition-metal-compound promoter comprising a manganese, iron, cobalt, nickel, or copper compound and an electrolyte such as polyacrylic acid, polymethacrylic acid, polyitaconic acid and poly-L-glutamic acid to a phosphating solution. These coatings are further improved by the incorporation of Fe ions. Thermal treatment of zinc phosphate coatings to generate α-phase anhydrous zinc phosphate improves the corrosion prevention qualities of the resulting coated metal.

26 Claims, 22 Drawing Sheets

ZINC PHOSPHATE CONVERSION COATINGS

This invention was made with Government support under contract number DE-ACO2-76CH00016, between the U.S. Department of Energy and Associated Universities, Inc. The Government may have certain rights in the invention.

RELATED APPLICATIONS

The subject application is a continuation of application Ser. No. 08/160,230 filed Dec. 2, 1993, which in turn is a continuation-in-part of U.S. patent application Ser. No. 07/944,230, filed Sep. 14, 1992, which in turn is a continuation-in-part of U.S. patent application Ser. No. 743,278, filed Aug. 9, 1991, all now abandoned, the contents of which are herein incorporated by reference.

BACKGROUND OF THE INVENTION

The subject invention relates to the preparation of zinc phosphate conversion crystal coatings, which may be in anhydrous or hydrous form. Such coatings can be deposited on ferrous metal, such as steel, or on non-ferrous metal surfaces, such as zinc or aluminum, to protect the metal surfaces from corrosion.

When high-temperature performance organic top coating systems (e.g. polyamide, polyphenylene sulfide, and polyquinoxalines) are applied directly to conventional crystalline zinc phosphate (Zn.Ph) hydrate conversion coat surface, high-temperature treatment of the topcoat to form a solid polymer film typically results in interfacial disbandment and separation due to dehydration of hydrous Zn.Ph crystals. This failure is associated with the formation of weak boundary layers and results in poor corrosion protection.

Poor corrosion protection also results from alkali-induced dissolution of coating layers caused by the attack of the hydroxyl ions generated by the cathodic reaction during the corrosion process.

To minimize corrosion, various methods have been devised. Early attempts at using phosphate coatings to produce a corrosion resistant surface include British Patent No. 731,882, published Jun. 15, 1955, employing phosphatizing solutions containing anions of orthophosphoric and nitrate acids, cations of zinc and nickel and/or cobalt, and lactic or glycollio acid, U.S. Pat. No. 3,597,283, issued Aug. 3, 1971 to Shee, enlisting solutions containing phosphate, zinc, nickel, cobalt or copper, magnesium, nitrite, and fluoride and/or chloride, and U.S. Pat. No. 3,850,700, issued Nov. 26, 1974 to Heller, using a phosphate solution including zinc oxide, phosphoric acid, nickelous oxide and nitric acid. Although Heller shows enhanced results when coated surfaces are baked at 300° F. to 400° F. for 2–10 minutes prior to the application of an electrophoretic paint, such treatment is insufficient to convert a hydrous zinc phosphate coating to its α-phase anhydrous form. Moreover, none of these references teaches or suggests the use of a polyelectrolyte, such as polyacrylic acid, polymethacrylic acid, polyitaconic acid and poly-L-glutamic acid.

Morrison, U.S. Pat. No. 3,837,928, issued Sep. 24, 1974, teaches a conversion coating. Essentially, Morrison uses a conventional phosphating liquid with the addition of a copolymer of an unsaturated carboxylic acid and a selected ethylenic monomer. However, no polymer corresponds to those used in the subject application. Brock, et al., U.S. Pat. No. 4,052,232, issued Oct. 4, 1977, teach that low molecular weight (leas than 50,000) soluble polymers comprising monomer moieties selected from acrylic acid, methacrylic acid, acrylamide and methacrylamide, when present in an acid metal phosphating solution modify the physical form of the sludge produced. However, there is no teaching to use a phosphating liquid containing cobalt or nickel. Moreover, only water soluble polymers having a molecular weight less than 50,000 were found effective in supplementing the phosphating process.

Steel is frequently galvanized—that is given a coating of zinc or an alloy of zinc—to provide protection against corrosion. For example, in the automotive industry, steel used for body panels, fasteners, and structural members in automobiles is often electroplated with zinc or a zinc alloy to provide corrosion resistance. Although such electrogalvanized steel ordinarily exhibits improved corrosion resistance relative to uncoated steel, electrogalvanized steel is generally subject attack by salt water. For example, a panel of electrogalvanized steel exposed to a spray of salt water will ordinarily develop a layer of "white rust," which represents deterioration of the zinc layer. Typically, after continued exposure to the salt-water spray, "red rust" will be observed, indicating that the zinc layer had deteriorated to such an extent that the underlying steel became exposed to the salt water. Electrogalvanized steel suffers the further disadvantage that paints, lacquers, and other conventional automotive finishes tend to adhere poorly to the zinc or zinc alloy surface.

It is an object of the present invention to overcome the drawbacks of known systems by providing zinc phosphate conversion coatings that inhibit oxygen reduction reactions and minimize alkali dissolution.

SUMMARY OF THE INVENTION

The subject invention provides a method of coating a metallic base, which comprises contacting the base with a composition containing (i) aqueous zinc phosphate; (ii) a transition-metal-compound promoter comprising manganese, iron, cobalt, nickel, or copper compound; and (iii) an electrolyte selected from the group consisting of polyacrylic acid, polymethacrylic acid, polyitaconic acid, and poly-L-glutamic acid.

Preferably, in the case of cobalt or nickel compounds or mixtures of cobalt and nickel compounds, cobalt and/or nickel in the composition comprise from about 0.1% to about 0.4% by weight of the total composition. Of particular interest are carbonates and/or nitrates, such as $Co(NO_3)_2.6H_2O$ or $Ni(N_3)_2.6H_2O$. These compounds are typically present at a concentration of from about 0.5% to about 2.0% by weight of the total composition.

It is preferred that the molecular weight of the electrolyte be from about 5,000 to about 100,000, and more preferably from about 50,000 to about 60,000.

Preferably, the method of the invention further comprises heating the coated surface of the metallic base following the contacting of the base with the composition. Such heating preferably converts the hydrous zinc phosphate to an α-phase anhydrous form. Preferably, the surface is heated to a temperature of from about 300° C. to about 350° C. for a period of about two hour.

The subject invention further provides a method for improving corrosion resistance of zinc phosphate conversion coating which comprises heating a zinc phosphated metal surface at a temperature of from about 300° to about 350° C. for a period of about two hours, so as, to convert any hydrous zinc phosphate in the conversion coating to its a-phase anhydrous form.

A zinc phosphate conversion coating composition comprising zinc phosphate; water; a cobalt, nickel, copper, manganese or iron compound, or mixture thereof; and an electrolyte selected from the group consisting of polyacrylic acid, polymethacrylic acid, polyitaconic acid and poly-L-glutamic acid is disclosed. One particularly preferred conversion composition comprises from about 0.3 to about 5.0 wt % $Zn_3(PO_4)_2.2H_2O$, from about 0.6 to about 10.0% by weight (wt %) $H_3PO_4$, from about 99.1 to about 85.0 wt % water, from about 0.5 to about 2.0 wt % $Ni(NO_3)_2.6H_2O$ and/or $Co(NO_3)_2.6H_2O$, and polyelectrolyte selected from the group consisting of polyacrylic acid, polymethacrylic acid, polyitaconic acid and poly-L-glutamic acid. A further preferred additive is Fe ion, generally present from about 2.4 parts per million (ppm) to about 5.6 ppm.

A preferred zinc phosphate conversion coating composition of the invention particular suitable for treating electrogalvanized steel surfaces comprises an aqueous solution of from about 2.0 to about 10.0% by weight zinc orthophosphate tetrahydrate, from about 4.0 to about 10.0% by weight $H_3PO_4$, from about 1.0 to about 5.0% by weight of an approximately 25% by weight aqueous colloidal solution of polyacrylic acid, and from about 0.1 to about 1.5% of a metal nitrate compound selected from $Co(N_3)_2.6H_2O$, $Fe(NO_3)_3.9\ H_2O$, $Ni(NO_3)_2.6H_2O$, $Cu(NO_3)_2.xH_2O$, $Mn(NO_3)_2.xH_2O$ and mixtures thereof. The molecular weight of the poly(acrylic acid) in the preferred composition is preferably approximately 60,000. Such a solution can be applied to surfaces of electrogalvanized steel by immersing the electrogalvanized steel into the solution or by spraying the solution onto surfaces of the electro-galvanized steel. For immersing eleotrogalvanized steel into such a solution, the solution is most preferably maintained at a temperature of about 80 degrees centigrade. For spraying the solution onto surfaces of electrogalvanized steel, the temperature of the solution is most preferably maintained at a temperature of about 90 degrees centigrade. Treating electrogalvanized steel with such a preferred solution can advantageously extend the service life of galvanized layers at protective barriers for the underlying steels. In addition, treating surfaces of electrogalvanized steel with such a preferred solution can contribute significantly to improving adhesion to a polymeric topcoat subsequently applied to the treated surfaces of the electrogalvanized steel.

DESCRIPTION OF THE FIGURES

FIG. 16 (*d*) and (*e*) show energy-dispersive x-ray spectra respectively of an electrogalvanized surface of a test panel of electrogalvanized steel and of a Zn.Ph coating surface of a test panel of Zn.Ph coated electrogalvanized steel.

DETAILED DESCRIPTION OF THE INVENTION

Figure 1:
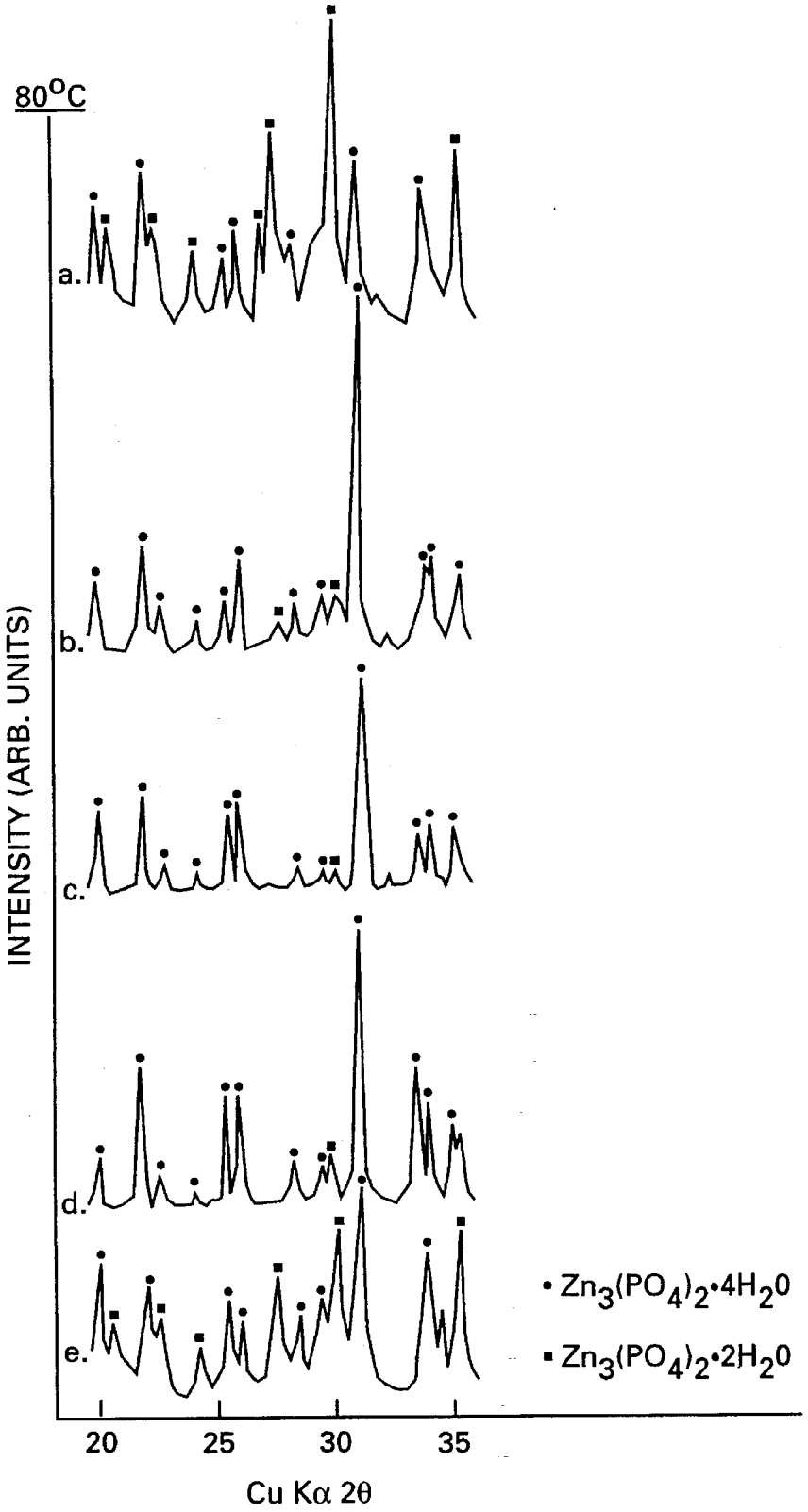
FIG. 1 illustrates X-Ray Powder Diffraction (XRD) patterns of conversion coatings derived from (a) unmodified, (b) cobalt, (c) nickel, (d) manganese and (e) calcium-modified zinc phosphating solutions at 80° C.

The present invention relates to the preparation of improved zinc phosphate coating systems especially suitable for use with high-temperature performance topcoat systems, such as polyphenylene sulfide (PPS), on metal surfaces, especially steels, such as cold-rolled carbon steel, or non-ferrous surfaces such as zinc and aluminum. These improvements can be achieved by employing one or more elements of the subject method. In a first element, improved zinc phosphating solutions are prepared by the addition of nickel, cobalt, copper, manganese or iron compounds to conventional zinc phosphate solutions. Nickel and cobalt compounds are particularly suitable for many applications. In a second element, the improved zinc phosphating solutions have been modified by the addition of a ductile polyelectrolyte, such as polyacrylic acid ["p(AA)"]. Such polyelectrolyte modified zinc phosphate formulations are disclosed in Sugama, etal. U.S. Pat. No. 4,659,395, herein incorporated by reference. In a third element, improved zinc phosphating solutions are prepared by thermal treatment of hydrous zinc phosphate coatings.

A preferred zinc phosphating solution consists of about 0.3–5.0 weight % $Zn_3(PO_4)_2.2H_2O$, about 0.6–10.0 wt % $H_3PO_4$ and about 99.1–85.0 wt % water. This solution is modified by the addition of a source of cobalt or nickel ions, or a mixture of these ions. The source of the cobalt and nickel ions may be environmentally compatible cobalt or nickel compound, and is preferably a carbonate or nitrate. The term "environmentally compatible", is to encompass all compounds whose discharge is not barred by law. The most preferred cobalt source is $Co(NO_3)_2.6H_2O$ and the most preferred nickel source is $Ni(NO_3)_2.6H_2O$. The ratio of the cobalt source to the nickel source may be from 100/0 to 0/100 by weight respectively. The concentration of the cobalt and/or nickel compounds added to the conventional zinc phosphate solution is preferably in the range of from less than about 0.5 to about 2.0% by weight of total solution, with the preferred concentration being at about 0.5% by weight.

The above preferred zinc phosphate solution may be modified by the addition of the polyelectrolyte at a concentration of about 0.5–5.0% by weight of the total solution.

A preferred thermal treatment can improve the coating by converting any hydrous zinc phosphate coating to an anhydrous form. Thus, thermal treatment may be used with conventional zinc phosphate coatings, and with either conventional or electrolyte modified zinc phosphate coatings to which has been added a source of nickel, cobalt, copper, manganese, or iron ions or a mixture of such ions. Thermal treatment is typically conducted at temperatures in the range of 300°–350° C. for approximately two hours, and causes dehydration of hydrous zinc phosphate to form anhydrous α-phase $Zn_3(PO_3)_2$. The α-phase crystals contribute significantly to decreasing susceptibility to alkali-induced dissolution. When a zinc phosphate coating on a metal surface is thermally treated before the polymer coating is applied, the resulting anhydrous coating provides lower rates of cathodic determinations of the polymer topcoat.

The improved zinc phosphating formulations are characterized primarily by their ductile nature resulting from the formation of a uniform array of plasticized fine, dense crystals and a primer action which results in formation of strong adhesive forces at the complex coating/protective polymer topcoat interface. These flexible crystalline coatings can be produced according to the following deposition procedures: steels, including galvanized and other plated or metal coated steels, or non-ferrous metals are treated by cleaning with washing reagents as a first surface modification stage, the cleaned metals are then immersed for up to roughly 30 minutes at around 80° C. in a zinc phosphating liquid which may be modified by the incorporation of an electrolyte, such as poly(acrylic acid) to which has been added a source of cobalt, nickel, copper, manganese, or iron ions or a mixture of such ions. Cobalt and/or nickel are particularly preferred. The basic zinc phosphating liquid consists, preferably, of a solution of about 5.0% by weight zinc orthophosphate dihydrate, about weight water and about 10.0% by weight $H_3PO_4$ mixed with metal nitrate hydrates at a ratio of about 1% by weight for each metal nitrate hydrate to the total zinc phosphate solution mass. The thus formed Zn.Ph-coated steel is then thermally treated at between 300°–350° C. for about two hours to convert hydrous zinc phosphate coating to the α-phase anhydrous form. If a polymer topcoat is desired, the resulting anhydrous Zn.Ph coated steel is dipped into an organic polymer, such as the high-temperature performance organic polymers polyphenylene sulfide, polyamide, polybenzimidazole or polyquinoxaline.

The following examples are illustrative of the present invention's improved zinc phosphate solutions and methods for preparing these solutions.

EXAMPLE 1

Materials and Measurements Used For Thermal Treatment Experiments

Materials

High strength cold-rolled sheet steel manufactured by the Bethlehem Steel Corporation was used as a metal substrate. The steel contained 0.06 wt % C, 0.6 wt % Mn, 0.6 wt % Si, and 0.07 wt % P. The formulation for the zinc phosphating liquid used in this study consisted of 5.0 wt % zinc orthophosphate dihydrate 10.0 wt % $H_3PO_4$, and 85.0 wt % water.

The Zn.Ph conversion coatings were prepared in the following manner. First, the steel surface was wiped with acetone-soaked tissues to remove any surface contamination due to mill oil. The steel was then immersed for up to 20 min in the conversion solution described above at a temperature of 80° C. After immersion, the surface was rinsed with water, and then dried in an oven at 60° C. for 30 min.

Measurements

To study phase transition and conversion of Zn.Ph coatings as a function of temperature up to 500° C. in air, the Zn.Ph crystal layers deposited on the steel surfaces were removed by scraping. They were then ground to a size of 325 mesh (0.044 mm) for use in analyses performed using the combined techniques of thermogravimetric analysis (TGA) coupled with differential thermal analysis (DTA), infrared (IR) spectroscopy, and X-ray powder diffraction (XRD).

The electrochemical testing for data on corrosion as performed with an EG&G Princeton Applied Research Model 362-1 Corrosion Measurement System. The electrolyte was a 0.5M sodium chloride solution made from distilled water and reagent grade salt. The specimen was mounted on a holder and then inserted into an EG&G Model K47 electrochemical cell. The tests were conducted in the aerated 0.5M NaCl solution at 25° C.; the exposed surface area of the specimens was 1.0 $cm^2$. The cathodic and anodic polarization curves were determined at a scan rate of 0.5 mV/sec in the corrosion potential range of −1.2 to −0.3 volts.

Alternations to the surface microtopography images and the changes in surface chemical components of the heat-treated Zn.Ph coatings before and after exposure to a 0.1M NaOH solution for 1 hr, were explored used AMR 100 Å scanning electron microscopy (SEM) associated with TN-2000 energy-dispersion X-ray spectrometry (EDX).

EXAMPLE 2

Materials and Measurements For Transition Metal Additives To conventional Zn.Ph solutions Materials An AISI 1010 low-carbon steel supplied by the Denman and Davis Co. was used as the metal substrate. The steel contained 0.08–0.13 wt % C, 0.30–0.60 wt % Mn, 0.04 wt % P, and 0.05 wt % S. The formulation for the unmodified zinc phosphating liquid used in this study consisted of 5.0 wt % zinc orthophosphate dihydrate [$Zn_3(PO)_2.2H_2O$], 10.0 wt % $H_3PO_4$ and 85.0 wt % water. In the modification of this standard formulation, four metal nitrate hydrates, $Co(NO_3)_2.6H_2O$, $Ni(NO_3)_2.6H_2O$, $Mn(NO_3)_2.4H_2O$, supplied by Aldrich Chemical Company, Inc., were employed as a source of ionic and/or elemental Co, Ni, Mn, and Ca atoms. These metal compounds at a concentration of 1.0% by weight of a total zinc phosphating solution mass were added to the phosphating solution, and then stirred until they were completely dissolved.

Polyphenylene sulfide (PPS), supplied by the Phillips 66 Company, was used as a high-temperature performance polymer topcoat. The "as-received" PPS was a finely divided tan colored powder having a low molecular weight and high melt flow. This powder was used for slurry coatings which were fused and cured (cross-linked and/or chain extension) at a temperature of 350° C., well above the 280° C. melting point of the polymer. The PPS polymer film was deposited on the dehydrated Zn.Ph Kα X-ray source operated at a constant power of 200 W (10 kV, 20 mA). The vacuum in the analyzer chamber of the instrument was maintained at $10^{-9}$ Tort throughout the experiments.

The electrochemical testing for data on corrosion was performed with an EG&G Princeton Applied Research Model 362-1 Corrosion Measurement System. The electrolyte was a 0.5M sodium chloride solution made from distilled water and reagent grade salt. The specimen was mounted in a holder and then inserted into a EG&G Model K47 electrochemical cell. The tests were conducted in the aerated 0.5M NaCl solution at 25° C., and the exposed surface area of the specimens was 1.0 $cm^2$. The cathodic and anodic polarization curves were determined at a scan rate of 0.5 mV/sec in the corrosion potential range of −1.2 to −0.3 volts.

The cathodic delamination tests for the PPS-coated anhydrous Zn.Ph specimens were conducted in an air covered 0.5M NaCl solution using an applied potential of −1.5 volts vs. SCE for a period of 3 days. A defect was made using a drill bit with a diameter of approximately 1 mm. After exposure, the specimens were removed from the cell and allowed to dry. The PPS coating was removed by cutting, and a delaminated region which appeared as a light gray area adjacent to the defect was detected.

EXAMPLE 3

Materials and Measurements For Ni and Co Additives To Electrolyte Modified Zn.Ph Solutions Materials An AISI 1010 cold-rolled steel supplied by the Denman and Davis Co. was used as the metal substrate. The steel contained 0.08–0.13 wt % C, 0.30–0.60 wt % Mn, 0.04 wt % P, and 0.05 wt % S. The formulation for the unmodified zinc phosphate liquid was 5.0 wt % zinc orthophosphate dihydrate [$Zn_3(PO_4)_2.2H_2O$], 10.0 wt % $H_3PO_4$ and 85.0 wt % water. In the modifying this standard formulation, two metal nitrate hydrates, $Co(NO_3)_2.6H_2O$, $Ni(NO_3)_2.6H_2O$, supplied by Aldrich Chemical Company, Inc., and 25% p(AA) colloidal solution obtained from Rohm and Haas Company, were employed as a source of the ionic Co and Ni atoms and the polyelectrolyte. The concentrations of these metal compounds and p(AA), (molecular weight of approx. 60,000) added to the zinc phosphate solution were 1.0% and 0.5% by weight of total standard solution, respectively. Five different ratios of $Co(NO_3)_2.6H_2O$ to $Ni(No_3)_2.6H_2O$ (100/0, 75/25, 50/50, 25/75, and 0/100 by weight) were used to compare their protective effects against corrosion. In preparing the samples, the steel surfaces were wiped with acetone-soaked tissues to remove any surface contamination from mill oil. The steel then was immersed for up to 20 min in these modified and unmodified conversion solutions at a temperature of 80° C.

Measurements

X-ray photoelectron spectroscopy (XPS) was used to identify the chemical states and elemental compositions at the outermost surface site of the p(AA)-Zn.Ph layers. The spectrometer used was a V. G. Scientific ESCA 3MK II with an Al Kα (1486.6 eV) X-ray source. The surfaces of conversion coatings were examined by Scanning Electron Microscopy (SEM) with an energy-dispersion X-ray spectrometry (EDX) attachment. The Zn.Ph crystal layers were scraped from the steel surfaces to study the phase compositions. They were then ground to a size of 325 mesh (0.044 mm) for X-ray powder diffraction (XRD). Measurements of corrosion were made in an EG&G Princeton Applied Research Model 362-1. The specimen was mounted in a holder and then inserted into a EG&G Model K47 electrochemical cell. The tests were conducted in an aerated 0.5M NaCl solution at 25° C., and the exposed surface area of the specimens was 1.0 $cm^2$. The cathodic polarization curves were determined at a scan rate of 0.5 mV/sec in the corrosion potential range of −1.2 to 0.3 volts.

EXAMPLE 4

Ni and Co Additives to Zn-Ph Coatings

The zinc phosphate coatings modified by the addition of Ni and/or Co ions are prepared and applied as described in Example 2.

SEM and EDX studies were performed on the Zn.Ph coated steels, producing SEM micrographs coupled with EDX spectra for crystalline Zn.Ph microstructures deposited on steel substrates by immersing them into metallic nitrate compound-modified and unmodified zinc phosphating solutions. The thickness of the conversion coating adhering to the substrates were determined using a surface profile measuring system. These results indicated that the coatings derived from the unmodified, Co—, Ni—, Mn— and Ca-modified phosphating solution systems had thicknesses of ~17.5, ~21.8, ~12.5, and ~17.5 μm, respectively. A standard Zn.Ph coating made using an unmodified solution is characterized by microstructure features which indicate an interlocking topography of rectangular-shape crystals precipitated on the steel. Compared with this, the crystal morphology resulting from the inclusion of Co in the phosphating solution was much different. In this case, a packed topography of plate-like crystals of a size >~30 μm was formed.

Quantitative analysis of any selected elements which exist at the depths of several micron from the solid surface can be performed using the EDX spectrum in conjunction with SEM inspection. In this case, the elemental ratio of selected atom-to-Zn peak counts per 30 sec was adapted as an approach to obtaining the quantitative information. For the coating film from the Co-modified solution system, the EDX data indicated an Fe-to-Zn ratio of 0.42 which was markedly lower than that for the control. In contrast, the P-to-Zn element ratios were similar. Since the Fe can only originate from the steel substrate, it is possible to assume that the presence of the Co atoms at the beginning of crystal growth serves to control the release of Fe ions from the steel surface.

The microstructure for the Ni system-derived conversion coating revealed a dense morphology coexisting with wide plate crystals and small block-type crystals. The P/Zn and Fe/Zn ratios were almost equal to those for the Co system. The presence of Ni in the crystals was barely detected since the Ni/Zn ratio was only 0.03, i.e., slightly lower than the Co/Zn ratio of 0.08. In contrast, a Mn/Zn ratio of 0.15 was detected for the Mn system-derived coating, suggesting that an appreciable amount of Mn can be introduced into the crystal.

Although SEM topographical and morphological features for the Ca-derived conversion coating are quire similar to those for the control, it appears from the EDX analysis that the crystal layers contained a large amount of Fe, whereas, there was no indication of Ca.

Based upon these results, it appears that the magnitude of diffusion and migration of these transition metal species in the crystal layer is in the following order: Mn>Co>Ni.

FIG. 1 illustrates the XRD phase compositions of crystalline conversion coatings derived from the different metallic nitrate compound-modified phosphating solutions at a temperature of 80° C. The XRD tracings indicated that even though these metallic species were dissolved in the solution, only two crystal phases were distinguishable; hopeits [$Zn_3(PO_4)_2.4H_2O$] and zinc orthophosphate dihydrate [$Zn_3(PO_4)_2.2H_2O$]. The relative proportions of the hopeits to zinc orthophosphate dihydrate depend upon the metallic species added to the solution. Hence, unmodified solution yields a phase composition consisting of dihydrate-based Zn.Ph as a major component and hopeits as a minor one. When Co—, Ni—, and Mn-modified solutions are used, they seem to promote the preferential precipitation of a single hopeits crystal layer. The data for the CA system, FIG. 1(*e*), Indicate an almost equal proportion of dihydrate— to tetrahydrate—based Zn.Ph phases.

From the above results and the EDX data, it is reasonable to conclude that the metallic species embedded in the crystal layers are present as ionic and elemental metals, as well as colloidal oxides or hydroxides.

Figure 2:
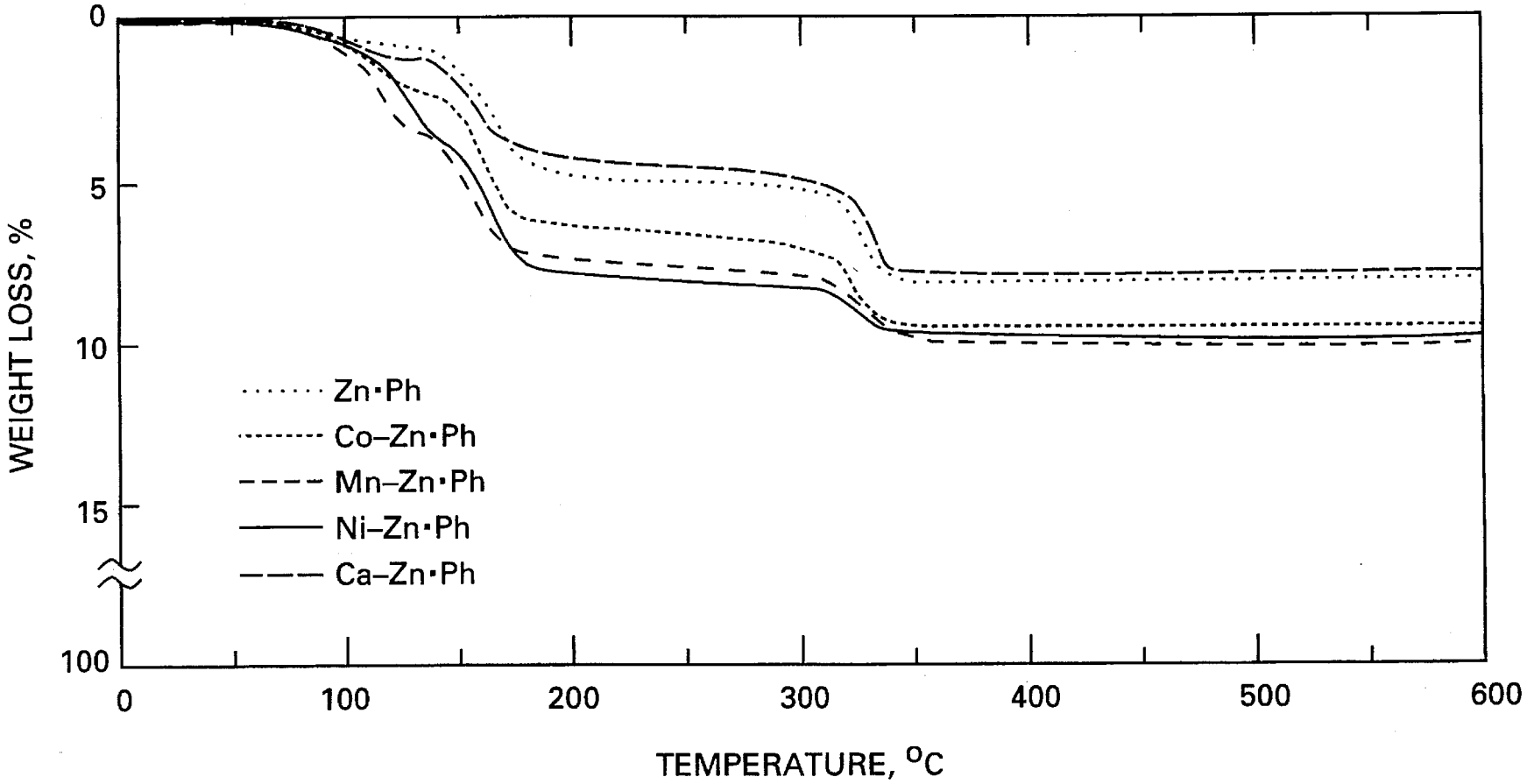
FIG. 2 shows thermographic analysis (TGA) curves of conversion coatings derived from the unmodified (-———-), co(- - - -), Ni(——), Mn(—), and ca(· · · ) modified phosphating solutions.

TGA curves for powder samples dried at 80° C. are depicted in FIG. 2. The onset temperature of decomposition was obtained by finding the intersection point of the two linear extrapolations. The curves for all of the samples indicate the presence of two thermal decomposition stages; the first occurs at a temperature between ~150° and ~180° C. and the second in the range from ~330° to ~340° C. The first decomposition stage is possibly associated with liberation of water chemisorbed to the crystal faces, and the latter may be due to the removal of crystallized water. Beyond a temperature of 340° C., the curves level off, implying that the conversion processes of hydration to dehydration phases were essentially completed. At Ca system-induced Zn.Ph exhibited a similar value. Somewhat higher weight losses (~11.3%) were measured for the other Zn.Ph systems. Thus, the major factors affecting the weight loss at temperatures up to 340° C. May be (1) the amount of water trapped by hydrogen bonding in the crystal layers, and (2) the number of crystallized water.

Figure 3:
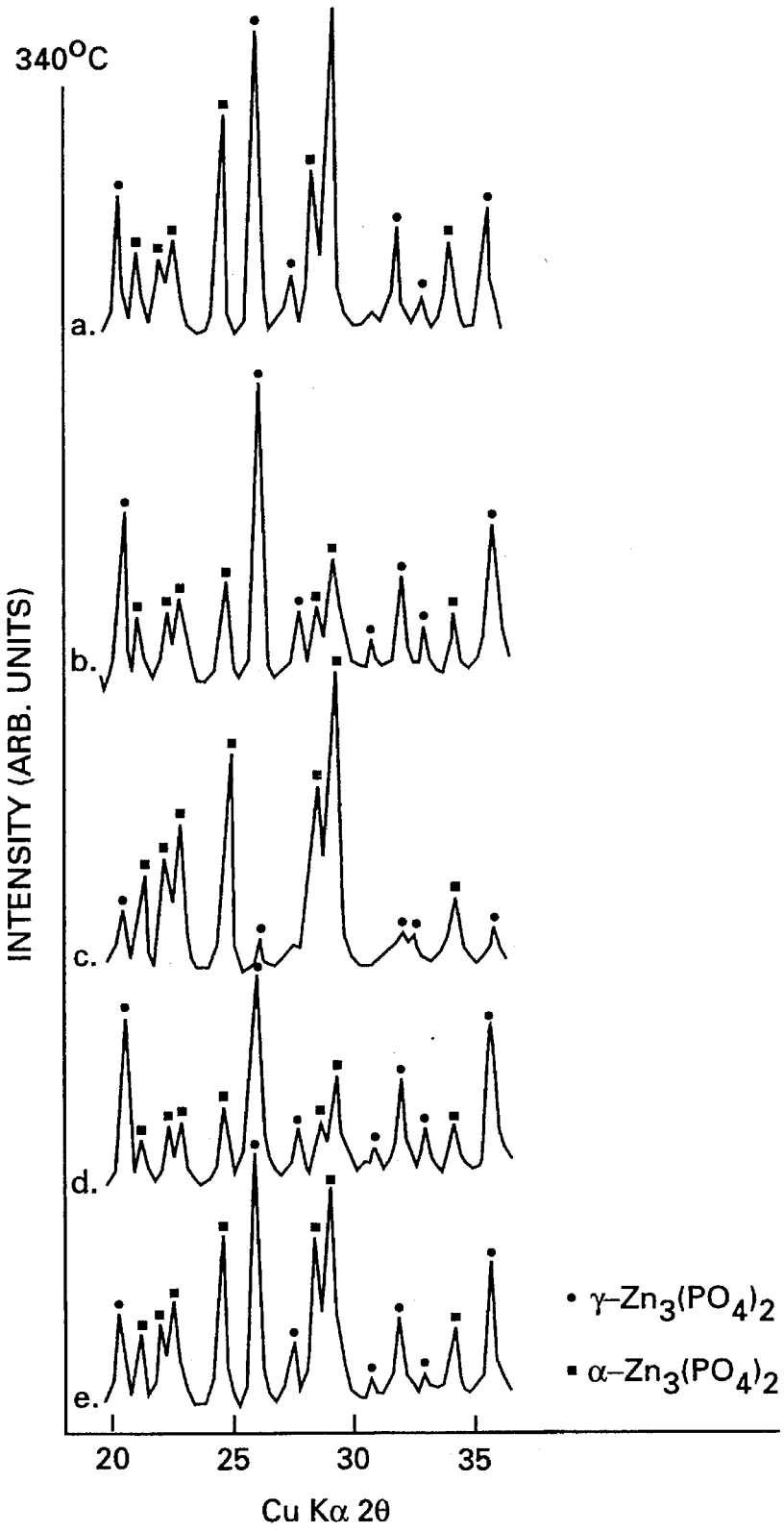
FIG. 3 shows XRD patterns of 340° C.-dehydrated (a) Zn.Ph, (b) Co—Zn. Ph, (c) Ni—Zn.Ph and (e) Ca—Zn.Ph systems.

XRD analyses were carried out to identify the phase assemblages of the dehydrated Zn.Ph compounds after heating for 2 hr at 340° C. The resultant xRD patterns arc illustrated in FIG. 3. It is clear that the phase compositions for all the samples consisted essentially of two anhydrous Zn.Ph components, the α- and γ-phases of $Zn_3(PO_4)_2$. No evidence for the presence of crystalline Co, Ni, Mn, and Ca compounds was found in these XRD tracings. For the control (FIG. 3-*a*), the anhydrous α- and γ-phases seem to be related to the original phases formed at 80° C.

Corrosion Protection

Based on the information described above, studies were directed towards three subjects: (1) determinations if metal atoms incorporated into anhydrous Zn.Ph layers inhibit cathodic reactions, (2) measurements of the alkali resistance of α- and γ-$Zn_3(PO_4)_2$ phases in high Ph environments created by the cathodic half reaction during the corrosion of steel at defects, and (3) determination of possible correlations between the findings from the above two subjects and the cathodic delamination rates of PPS topcoats from phosphated steel.

Referring to the first subject, studies were focused upon he chemical states of 340° C.-oxidized transition metal species incorporated into anhydrous crystal lattices, and the chemical transformation and conversion of the oxidized metal compounds after exposure to a 0.1M NaOH solution. XPS was used to obtain the information. XPS high-resolution spectra for the $Co_{2p3/2}$, $Ni_{2p3/2}$, and $Mn_{2p3/2}$ core levels of Co—, Ni— and Mn-incorporated Zn.Ph samples surfaces were determined. Data were taken before and after exposure to the NaOH. For the unexposed samples, the spectra for the Co sample indicates a major peak at 782.7 Ev which corresponds to the Co in the CoO formed by the oxidation of the Co atom in the dehydration of Zn.Ph upon heating in air at 340° C. The peak emerging at 856.7 Ev for the Ni sample reveals the presence of two Ni oxide compounds, nickel oxide (NiO) and nickelic oxide ($Ni_2O_3$). The formation of pyrolusite ($MnO_2$) and the surface of the oxidized Mn sample can be recognized by the main signal at 642.5 Ev in the $Mn_{2p3/2}$ region.

After exposure to NaOH, no pronounce peaks were found in the spectra for the $Co_{2p3/2}$ and $Ni_{2p3/2}$ regions of the Co and Ni samples. This implies that a certain amount of Co and Ni atoms precipitates on the outermost surface sites of the Zn.Ph layers, but they do not diffuse into the layers. Therefore, NaOH-induced dissolution of the coating surfaces results in complete elimination of these atoms.

Figure 4:
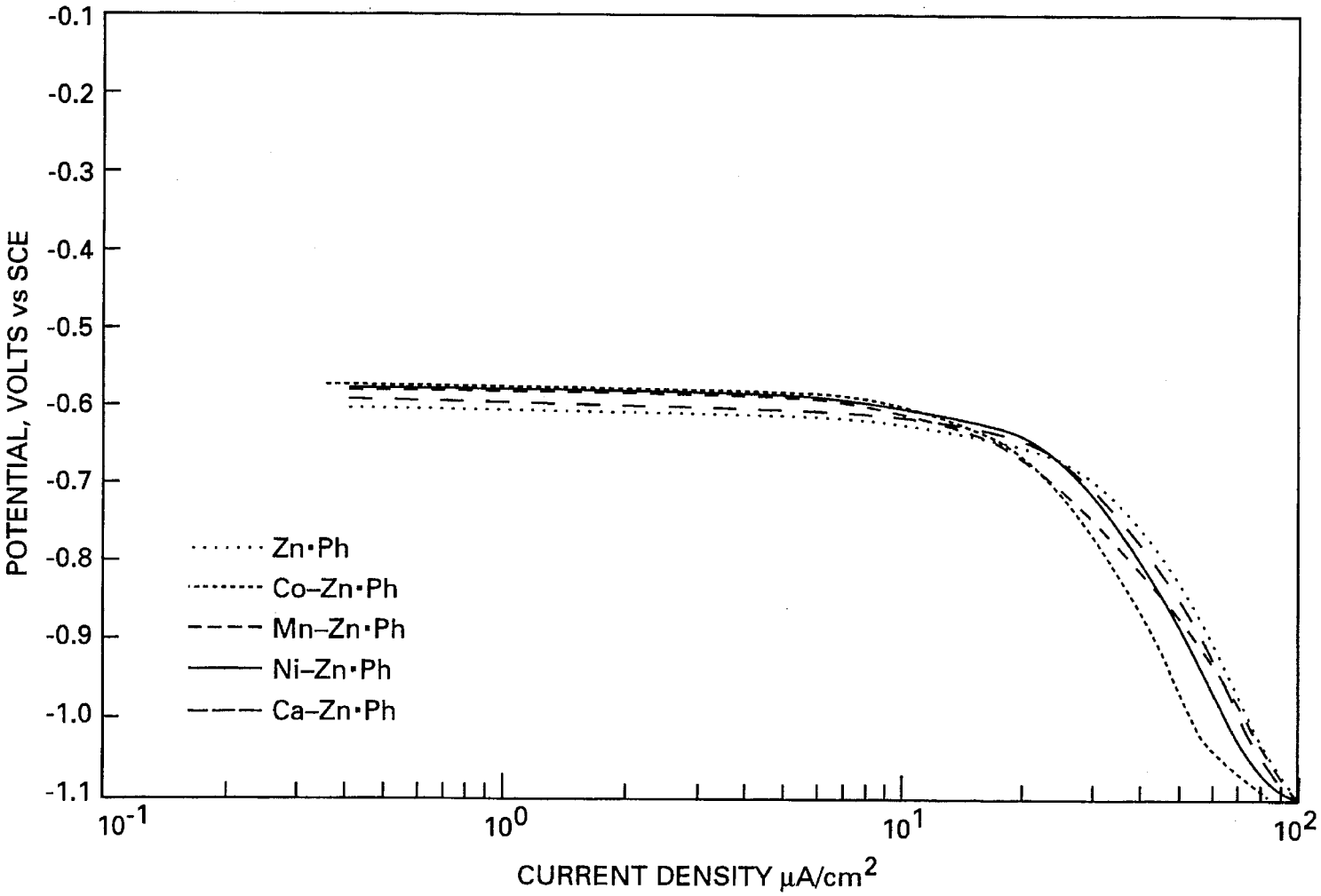
FIG. 4 shows comparisons of cathodic polarization curves for 340° C. treated unmodified (- ———-), Co(- - - -), Ni(——), Mn(—), and Ca(· · · ) -modified Zn.Ph coatings.

FIG. 4 shows typical cathodic polarization curves of log current density versus potential for the metal oxides-adsorbed and unabsorbed Zn.Ph sample, the current density for the CoO-adsorbed Zn.Ph sample in the potential region between the −1.1 and −0.9 V, was significantly less. The next lowest current density for he same potential region was obtained from coatings containing Ni oxides in the crystal lattices. In contrast, $MnO_2$ existing on the Zn.Ph surface seems to play no effective role in shifting the current density to a lower site. Since the indication of lower current density is attributed to a lower hydrogen reaction, this result is confirming evidence that the oxygen reduction reaction, $H_2O+1/2O_2+2e=2OH$, of the Zn.Ph-coated steel, was inhibited by incorporating the CoO, NiO, and $Ni_2O_3$ into the Zn.Ph.

The Co and Ni cations serve to suppress the cathodic reaction on the Zn.Ph surfaces. A further question then is which one of two $Zn_3(PO_4)_2$ phases, α and γ, is less susceptible to the alkali-induced dissolution. In order to address this question, metal oxide-incorporated and unincorporated Zn.Ph samples were exposed to a 0.1M NaOH solution for up to 48 hrs. The weight loss caused by the alkali dissolution of Zn.Ph was measured as a functional of the exposure times. The results indicate that the weight loss in a crystal layer comprised of the $\gamma$-$Zn_3(PO_4)_2$ phase as major crystal component progressively increases with an increase in the exposure time. In contrast, a significantly lower weight loss was determined for the crystal layer consisting of the mixed phases of both the $\alpha$ and $\gamma$, and the single $\alpha$-phase as the major constituent. This clearly verified that the $\gamma$-phase has a considerably high magnitude in susceptibility to alkali dissolution, compared with that of $\alpha$-phase. These results were related directly to the rates of cathodic delamination of PPS topcoat films from the Zn.Ph-deposited steels.

EXAMPLE 5

Ni and Co Additives To Electrolyte Modified Zn.Ph Coating

Electrolyte modified zinc phosphate coatings containing Ni and Co were prepared and applied as described in Example 3.

Coating Layers Fumed in the Initial Periods of Zn.Ph-Conversion Process

To investigate the effect of $Co^{2+}$, $Ni^{2+}$, and p(AA) additives on the promotion of crystal growth at the initial stage of Zn.Ph precipitation, the steel samples were immersed for only 5 min and the conversion products explored using XPS and SEM-EDX. Much of these data are reported in T. Sugama and R. Broyer Surface and Coatings Tech., 50:89–95 (1992), the contents of which is herein incorporated by reference. Table 1 summarizes the XPS data on changes in the elemental composition of the sample surface as a function of the $Co(NO_3)_2.6H_2O$-to-$Ni(NO_3)_2.6H_2O$ ratio. For all of the samples, the principal element occupying the outermost surface sites was oxygen, in the concentration range of 43 to 55%, and the second predominant element was carbon, corresponding to the hydrocarbon in p(AA) chemisorbed and diffused on the conversion product surfaces. By comparison with the elemental composition of the control sample, denoted as 0/0 ratio, the Co-modified sample (100/0) was characterized by a conspicuous increase in concentration of Zn and P atoms, with a concomitant reduction in the content of the Fe atom which is representative of both the steel substrate and the Fe-based conversion products. Since Zn and P atoms directly reflect the precipitation of Z.Ph on the steel, the $Co^{2+}$ ions dissolved in the phosphating solution promote the precipitation of Zn.Ph crystals.

TABLE 1

Surface Chemical Composition of Unmodified, and Co- and Ni-Modified Conversion Coatings at the Beginning of Precipitation of Zn.Ph

| $Co(NO_3)_2.6H_2O$/ $Ni(NO_3)_2.6H_2O$ | Atomic Concentration, % | | | | |
|---|---|---|---|---|---|
| Ratio | P | C | O | Fe | Zn |
| 0/0 | 4.1 | 29.7 | 55.0 | 9.4 | 1.7 |
| 100/0 | 12.2 | 24.8 | 51.6 | 4.8 | 6.5 |
| 75/25 | 12.7 | 25.9 | 50.6 | 4.8 | 6.0 |
| 50/50 | 10.9 | 33.3 | 43.3 | 7.5 | 4.9 |
| 0/100 | 10.7 | 32.7 | 44.6 | 7.7 | 4.3 |

Figure 5A:
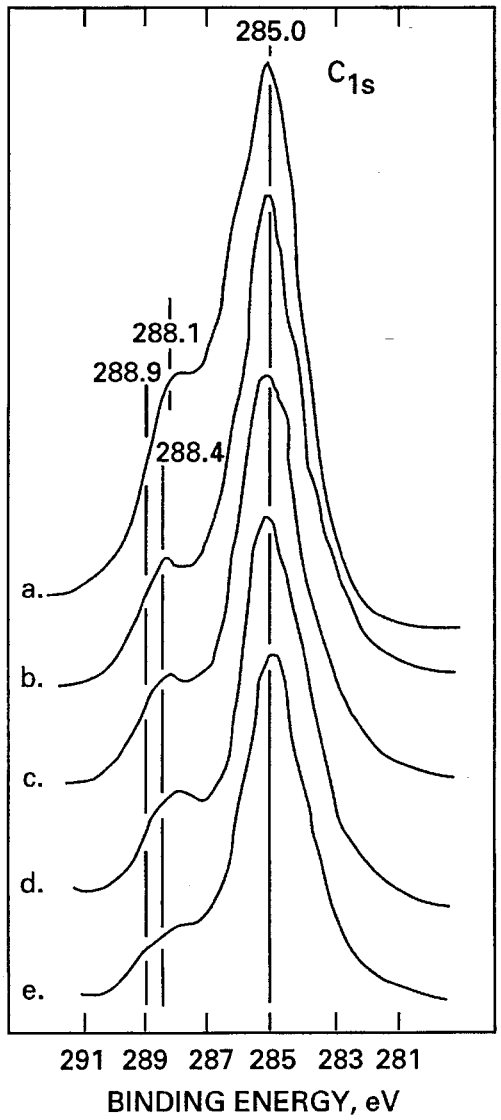
FIG. 5 shows the X-ray photoelectron spectroscopy (XPS) high-resolution spectra in $C_{is}$ and $Ni_{2p3/2}$ regions for control (a), Co/Ni 100/0(b), 50/50(c), 25/75(d), and 0/100(e) ratio Zn.Ph conversion coatings.
Figure 5B:
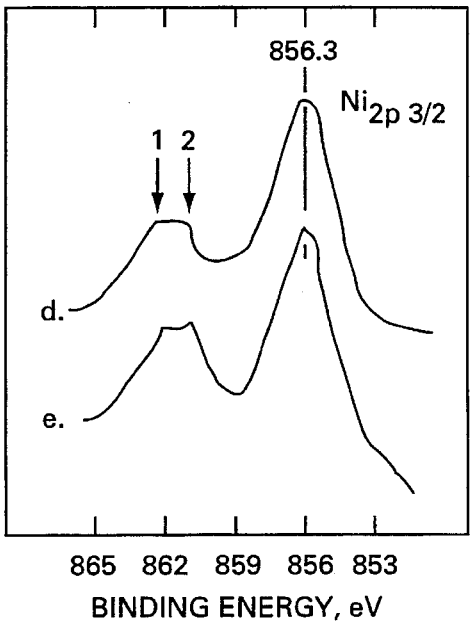
Figure 6A:
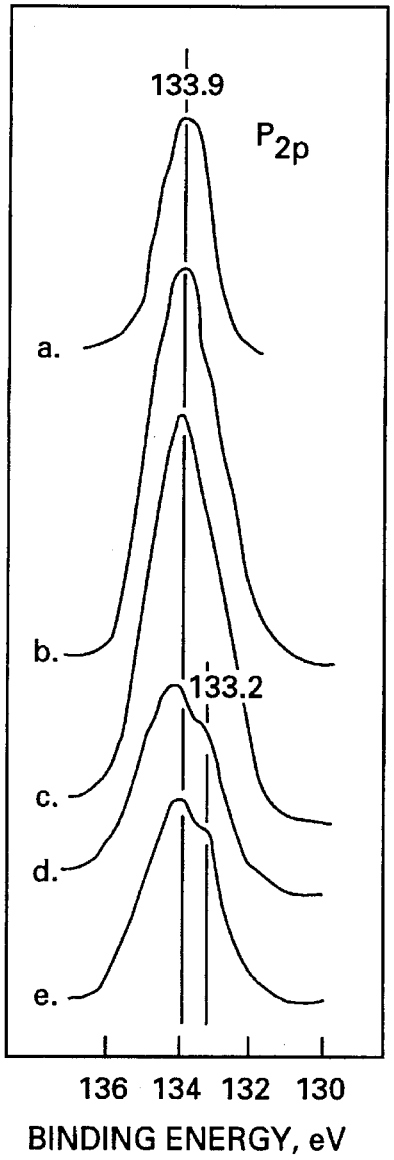
FIG. 6*a* and 6*b*, respectively show the x-ray photoelectron spectroscopy (XPS) high-resolution spectra in $P_{2p}$ and $Fe_{2p3/2}$ regions for control (a), Co/Ni 100/0 (b), 50/50 (c), 25/75 (d) , and 0/100 (e) ratio Zn.Ph conversion coatings.
Figure 6B:
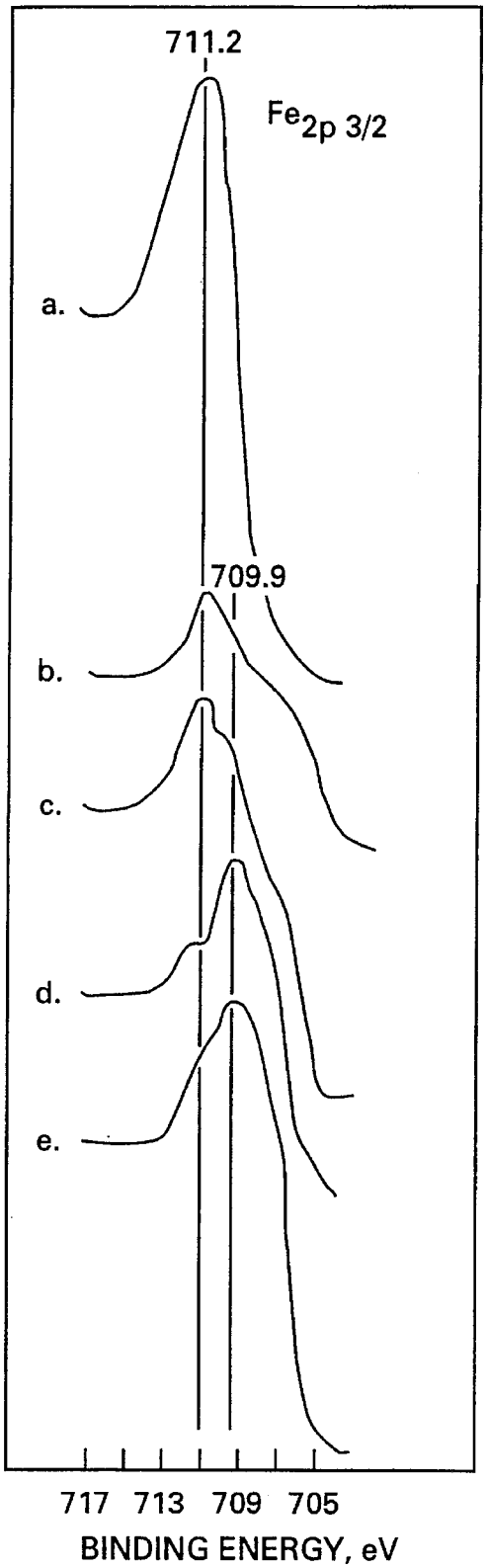

The chemical states and compounds in the conversion products of these samples were identified from the deconvoluted curve of the high-resolution XPS spectra of $C_{1s}$, $Ni_{2p}$, $P_{2p}$, and $Fe_{2p3/2}$ signals. To set a scale in all the XPS spectra, the binding energy (BE) was calibrated with the $C_{1s}$, of the principal hydrocarbon-type carbon peak fixed at 285.08V as an internal reference standard. The resulting spectra are shown in FIGS. 5 and 6. The curves a, b, c, d, and e correspond to samples with Co/Ni ratios of 0/0, 100/0, 50/50, 28/75, and 0/100, respectively. In the $C_{1s}$ regions (see FIG. 5), the spectrum of the control sample (curve a) reveals the three resolvable Gaussian components at BE of 285.0, 288.1, and 288.9 Ev. The main peak at 285.0 Ev as a principle components is attributable to the hydrocarbons in the main chain of 9(AA). The peak emerging at 288.1 eV in a high BE area can be ascribed to the carbon in the —$COO^-Zn^{2+}$—ooc-salt complex formation, and 288.9 eV is due to C originating from carboxylic acid, COOH, in the p(AA). The spectra for all of the Co- and Ni-incorporated Zn.Ph samples show a slight shift in the salt complex-related peak to a higher BE site compared to that of the control. The assignments of the shifted peak at 288.4 eV appear to be due to the Co- and Ni—OOC salt complexes. In fact, the $O_{1s}$ core level (not shown) had a strong peak at 531.4 eV, which was ascribed to the formation of COO-metal complexes. This finding strongly suggested that the functional COOH groups in the p(AA) preferentially react with the Co and Ni ions to precipitate the salt complex, rather than reacting with the Zn ions. The extent of reactivity of these metal ions with p(AA) appears to be in the following order Co>Ni>Zn. In the $P_{2p}$ core level spectra, see FIG. 6, the curve for the control sample reveals only a single peak at 133.9 ev, reflecting the P in the Zn.Ph precipitated on the steel. The intensity of this peak markedly increased, as the control solution was modified by Co2+ ions. Since such an intense peak represents the deposition of a large amount of Zn.Ph, it is clear that Co ions have the significant effect on the acceleration of crystal growth and precipitation.

SEM micrographs coupled with EDX spectra for the crystalline Zn.Ph microstructure deposited on steel substrates after immersion for 5 min into control solutions, and into Co-modified zinc phosphate solutions at 80° C. were prepared. At the start of Zn.Ph crystal growth, a standard Zn.Ph coating made with the unmodified solution, was characterized by an irregular precipitation of rectangular-shaped plate crystals on the $Fe_2O_3$ surfaces. Crystal morphology of conversion coatings derived from Co-modified solution can be discriminated from that of standard coatings; in the former the precipitation of large, well-formed plate-like crystals over 20 μm in size was observed. This change was due to the effect of Co ions causing an increase in the rate of the Zn. Ph crystal growth and development. The particular microstructural feature of the Ni system-derived conversion coatings, was a dense morphology with wide plate crystals coexisting with small block-type crystals. The EDX spectrum for the large crystals is indicative of the formation of Zn.Ph containing a large amount of Fe and a small amount of Ni. The areas not covered with Zn.Ph deposits are composed of an amorphous Fe-rich phosphate oxide compound superimposed on the $Fe_2O_3$ layers, no Ni was found in these areas.

Figure 7:
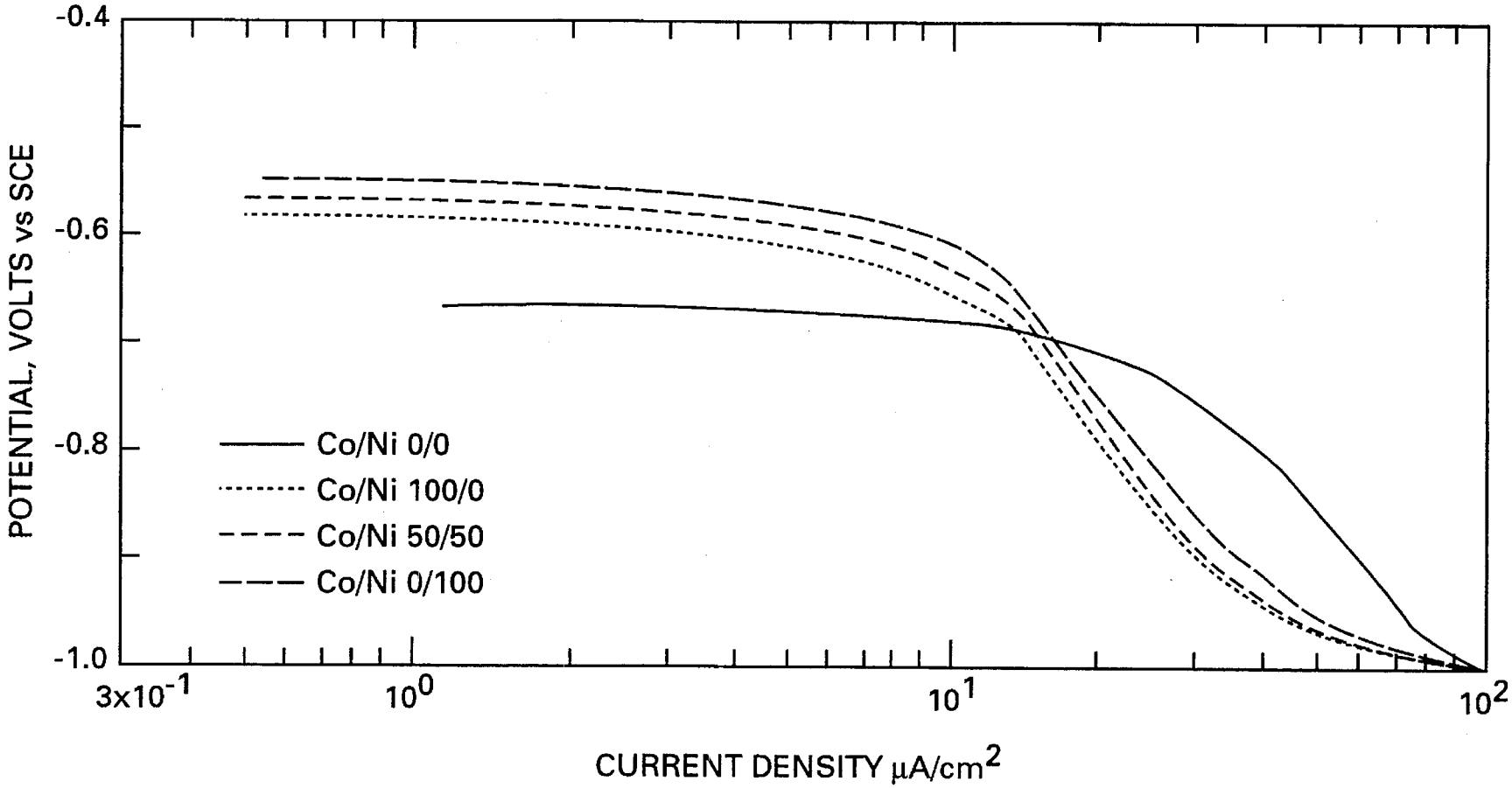
FIG. 7 shows comparisons of cathodic polarization curves for unmodified and Co and Ni-modified Zn.Ph conversion coatings at the beginning of precipitation of Zn. Ph.

FIG. 7 presents typical cathodic polarization curves of log current density versus potential for the control, and Co/Ni 100/0, 50/50, and 0/100 ratio samples in an aerated 0.5M NaCl solution. By comparison with the curve for the control, the striking characteristics of the cathodic curves for all the Co-and Ni-modified Zn.Ph samples are as follows: (1) a considerable reduction of current density in the potential region between–0.95 and –0.80 V, and (2) a large shift in $E_{corr}$ to less negative potentials.

Referring to the first characteristic (1), the indication of low current density is attributed to an inhibition of the cathodic reaction, particularly the oxygen reduction reaction. Such a reaction appears to be inhibited by incorporating the Co— and Ni-complexed p(AA) macromolecule and Co and Ni hydroxides in the Zn.Ph layers.

The second characteristic (2) directly reflects the degree of coverage providing a conversion coatings on the entire steel surface; namely, a good coverage providing a continuous nonporous coating, corresponds to the $E_{corr}$ value at a less negative site. The consequent $E_{corr}$ values for the control, 100/0, 50/50, and 0/100 samples were –0.66, –0.57, –0.55, and –0.53 V, respectively. Consequently, the most effective coverage of conversion coatings, which provide corrosion protection of steel, seem to be those prepared with Ni-modified phosphate solutions. This finding strongly suggests that good protection performance of conversion coating systems is due to two important factors: 1) a high degree of coverage by packed crystal layers consisting of large— and fine-crystal particles, and 2) the formation of amorphous Fe-rich phosphate oxide compounds in the vicinity of $Fe_2O_3$.

Coating Layers Formed in the Terminal Stages of the Conversion Process

Figure 8:
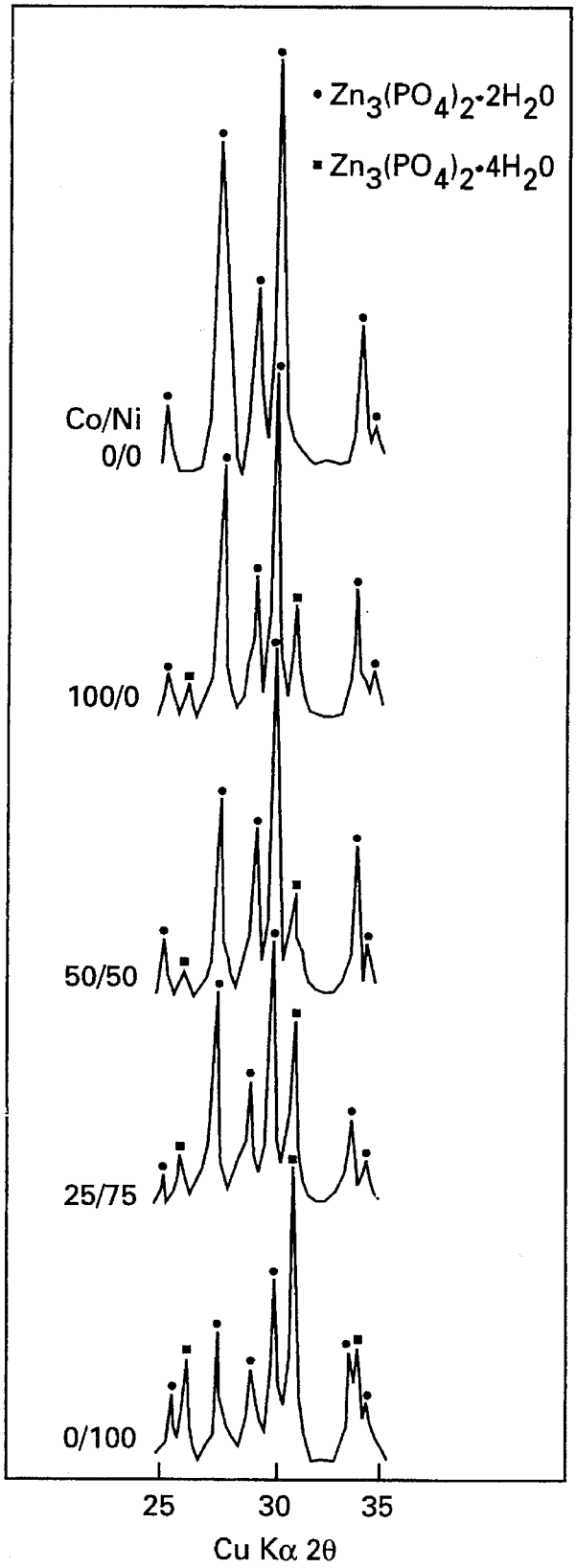
FIG. 8 shows XRD patterns for conversion coatings derived from unmodified, and Co— and Ni-modified Zn.Ph solutions.
Figure 9:
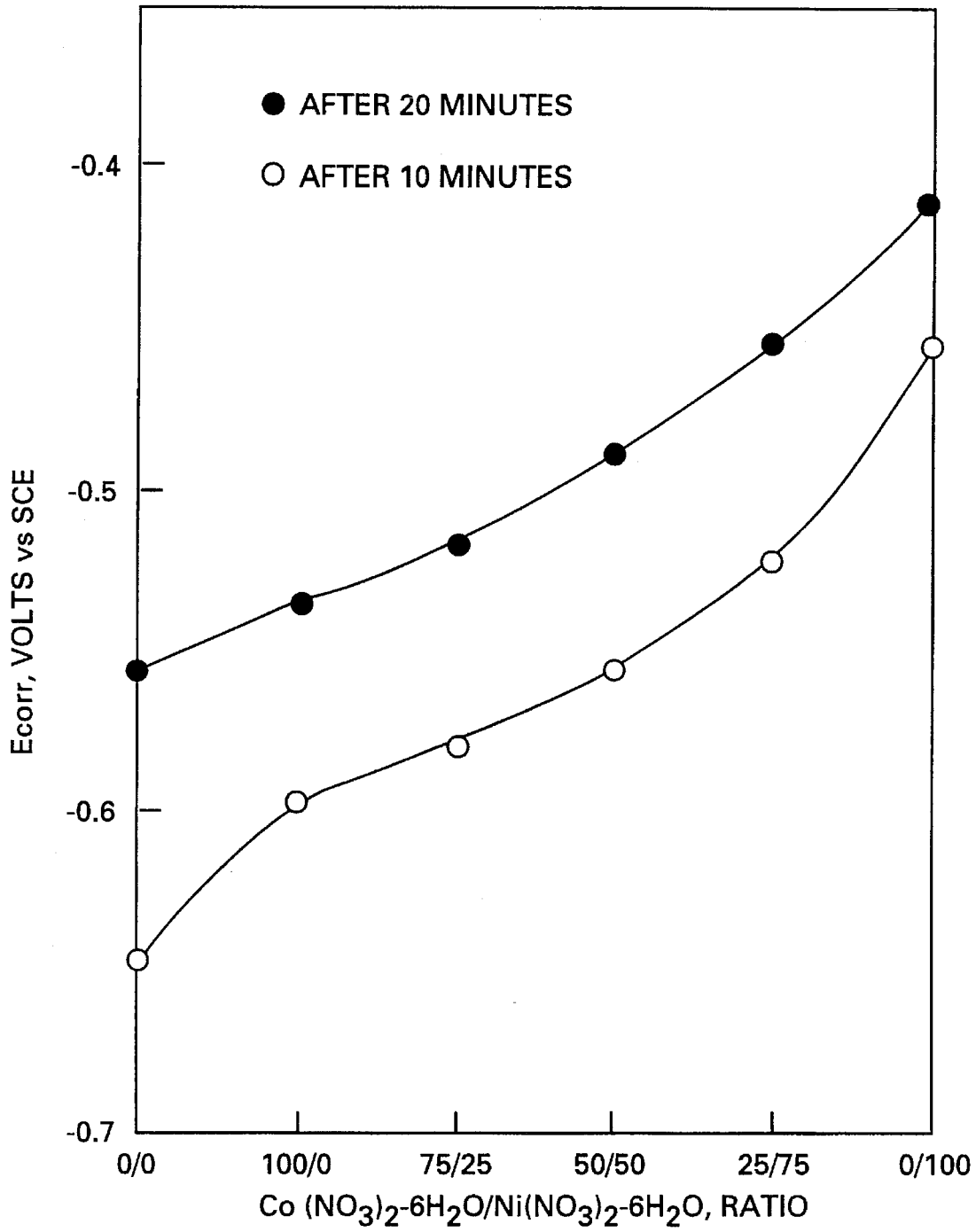
FIG. 9 shows variations in corrosion potential values, $E_{corr}$, as a function of Co/Ni ration for Zn.Ph-covered steel samples prepared by immersion for 10 and 20 minutes.

FIG. 8 illustrates the XRD phase compositions of crystalline conversion coatings prepared by immersing the steel for 20 min in the unmodified and modified phosphate solutions at 80° C. Only two crystal phases were distinguishable; zinc orthophosphate dihydrate [$Zn_3(PO_4)_2.2H_2O$] and hopeits [$Zn_3(PO_4)_2.4H_2O$]. The proportions of single $Zn_3(PO_4)_2.2H_2O$ formation derived from the central solution system (Co/Ni, O/O) tended to be replaced by hopeits formation as the Co/Ni ratio was decreased. The microstructural view of well-converted crystal compounds for the Ni-modified Zn.Ph disclosed an interlocking topography of growing crystals which uniformly covered the steel surfaces. The feature of EDX spectrum for a part of the crystal was almost the same as that of the crystals formed at the beginning of the conversion process. All findings were correlated directly with the evaluation of $E_{corr}$ value for the conversion coating deposited on the steels after immersion for 10 and 20 min, respectively. The variation in $E_{corr}$ of the samples as a function of Co/Ni ratio is given in FIG. 9. The ability of the conversion coatings to protect steel against corrosion depends primarily on the Co/Ni ratio. The most promising protection coating system may be produced using Ni-incorporated phosphate solutions; an immersion time of 20 min. rather than of 10 min. leads to better coverage.

Improved Zn.Ph conversion coatings providing significant corrosion protection to steel may be prepared by immersing steel into a $Co^{2+}$ and $Ni^{2+}$ ions-incorporated p(AA)-zinc phosphate solution system. Formation of $M^{2+}$ (M: Co and Ni)-p(AA) salt complexes containing —$COO^-$ $M^{2+}$—OOC-groups plays an important role in accelerating and promoting growth and development of Zn.Ph crystal layers over the steel, and introduces amorphous Fe-rich phosphate conversion layers in the vicinity of $Fe_2O_3$ substrates. The electron trapping behavior of the $M^{2+}$ ions dissociated from the complex formations and M hydroxides in the NaCl solution inhibited the cathodic reaction. In the final stages of the conversion process, the crystal phase of Ni system-derived conversion coatings consisted of hopeits, [$Zn_3(PO_4)_2.4H_2O$] as the major component and zinc orthophosphate dihydrate [$Zn_3(PO_4)_2.2H_2O$] as the minor one. The uniform coverage of hopeite-$Zn_3(PO_4)_2.2H_2O$ interlocked crystals over the steel resulted in a great reduction in the rate of corrosion.

EXAMPLE 6

Thermal Treatment of Zinc Phosphate Conversion Coatings

Zinc phosphate conversion coatings were prepared, applied and thermally treated as described in Example 1.

Figure 10:
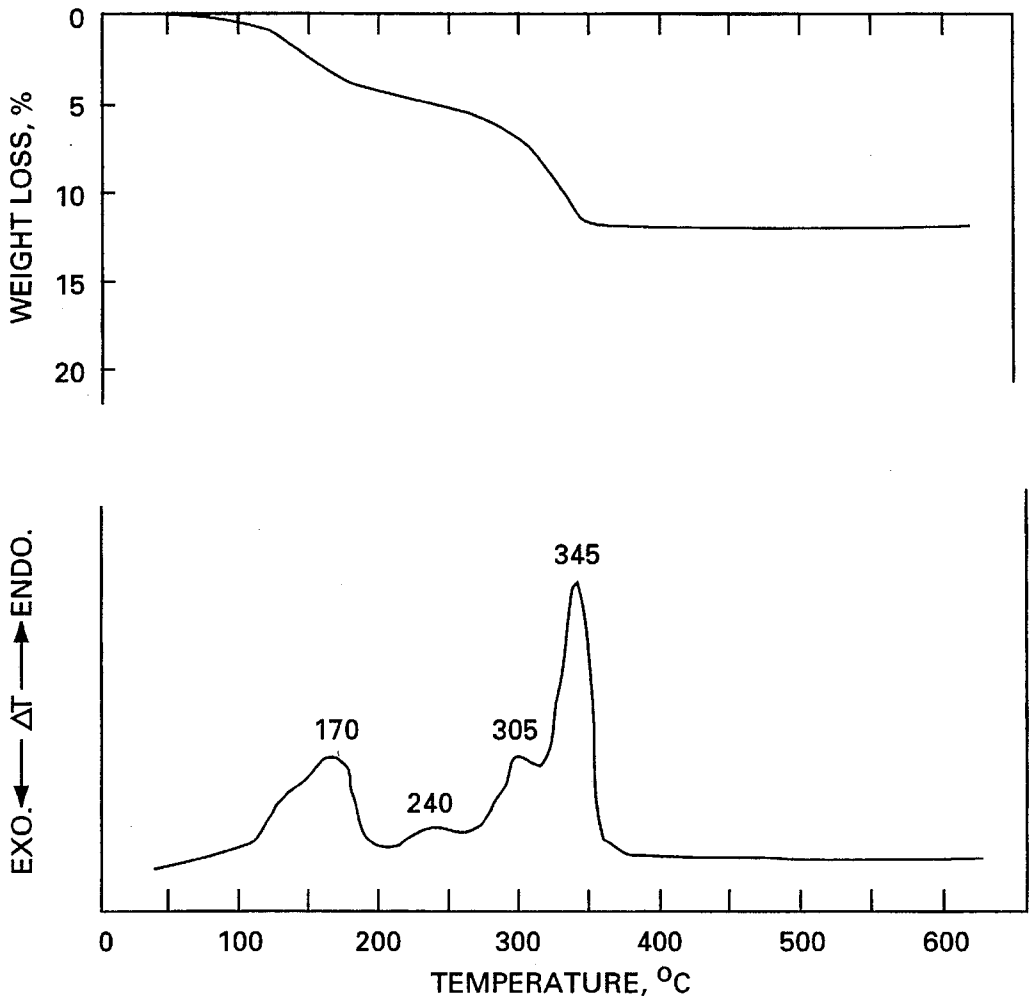
FIG. 10 shows typical TGA-DTA curves for zinc phosphate conversion coatings deposited on steel surfaces.

FIG. 10 shows typical TGA-DTA curves for a powdered Zn.Ph conversion coating deposited on a steel surface after drying at 60° C. for 24 hr. The curve indicates that heating to 170° C. results in a weight loss of approximately 4%. Based upon the broad endothermic peak on the DTA curve at the same temperature, weight loss is likely to be due to removal of evaporable water, such as free water and water adsorbed on the crystal. The curve also illustrates the kinetics of eliminating non-evaporable water upon heating Zn.Ph compounds. Reduction in weight of approximately s% occurring over the temperature range 170° to 350° C. is probably associated with liberation of crystallized water existing in the Zn.Ph compounds, and appears directly related to the prominent DTA endothermal peak at 345° C. Beyond approximately 4° C., the weight loss curve seems to level off, suggesting that conversion of hydrous Zn.Ph compound into an anhydrous Zn.Ph is completed.

Figure 11:
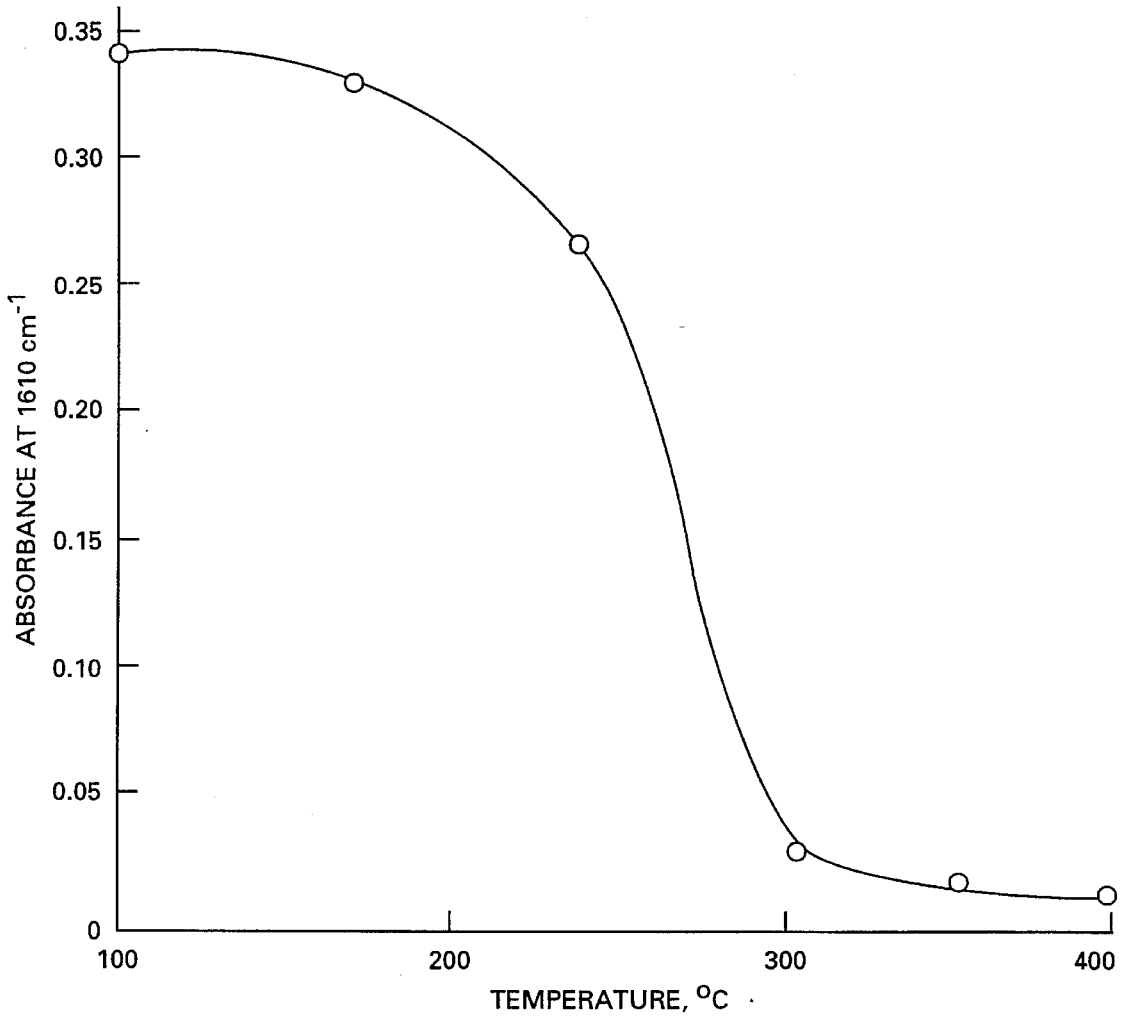
FIG. 11 shows the changes in IR absorbance of H—O—H at $1610cm^{-1}$ as a function of temperature for zinc phosphate coatings deposited on steel surfaces.
Figure 12:
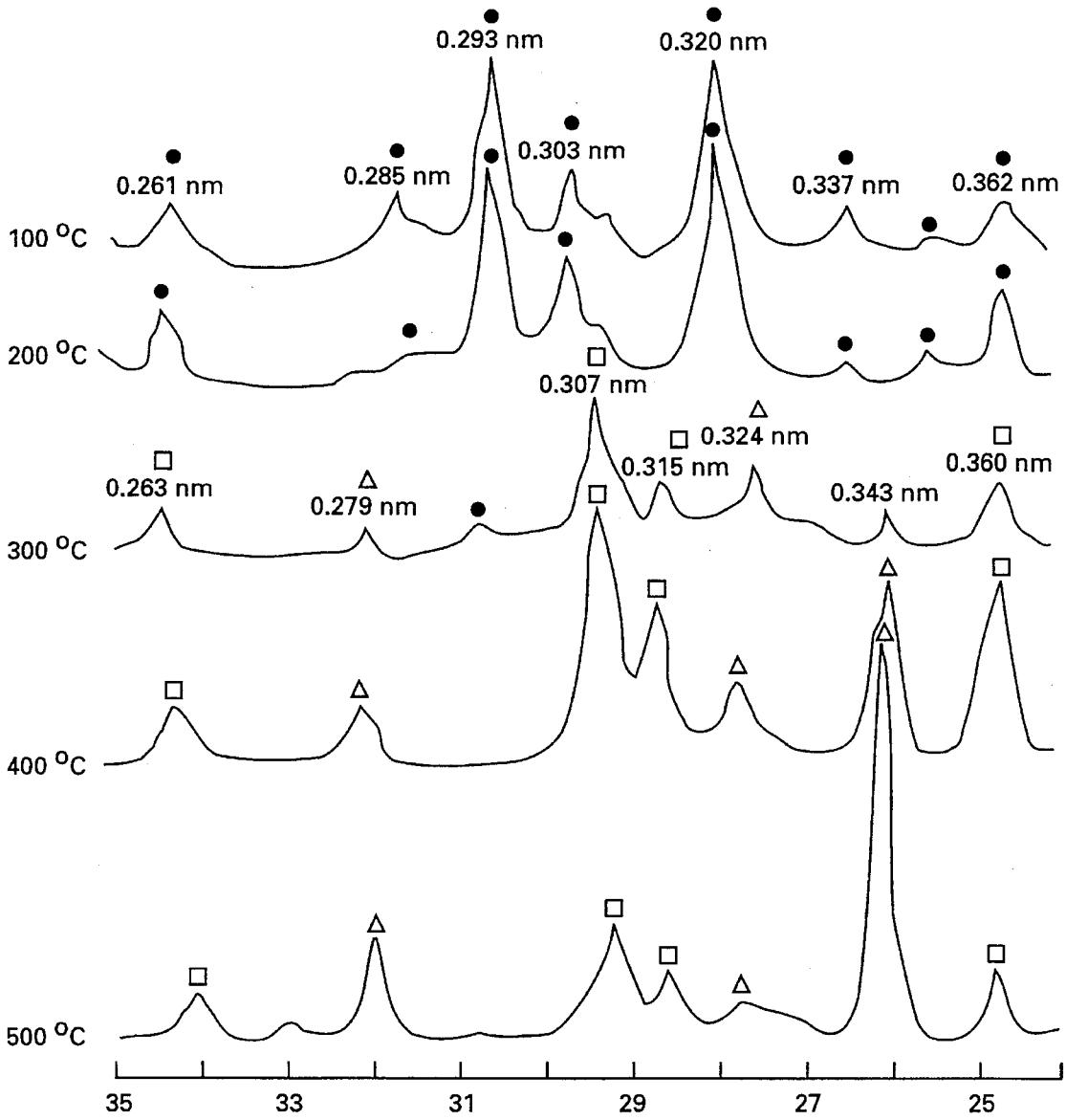
FIG. 12 shows XRD patterns of 100°-, 200°-, 300°-, 400°-, and 500° C.- treated Zn.Ph layers; $Zn_3(Po_4)_2$-$2H_2O$(●),α-Zn3$(PO_4)_2$(□), and —$Zn_3(PO_4)_2$(Δ).

In addition to TGA-DTA studies, IR and XRD analyses were performed. These data are shown in FIGS. 11 and 12, respectively. An estimate of the rate of liberation of crystallized water from the Zn.Ph compounds as a function of temperature was made by plotting variations in IR absorbance with temperature at a frequency of 1610 $cm^{-1}$, which reveals the H—O—H bonding vibration of water of crystallization (see FIG. 11). As evident from the absorbance re. temperature curve, absorbance decreased rapidly upon heating to 300° C., beyond this temperature it leveled off. This suggests that to a large extent, dehydration of Zn.Ph occurs in air at temperatures <300° C. In fact, the XRD pattern (see FIG. 12 –300° C.) for the diffraction range 0.256 to 0.371 nm, clearly indicates the formation of anhydrous $\alpha$-$Zn_3(PO_4)_2$ as the major phase and anhydrous $\gamma$-$Zn_3(PO_4)_2$ as a minor phase. All XRD lines for samples treated at temperatures ≦200° C. are associated with the original $Zn_3(PO_4)_2.2H_2O$ phase, implying that conversion to the anhydrous phases occurs at a temperature between 200° to 300° C. However, as indicated by the weak diffraction line at 0.293 nm which ascribes to the hydrous Zn.Ph compounds, the hydrous→anhydrous conversion was not complete at 300° C. This line disappeared when the sample was oven-heated at 400° C. for 1 hr. At 500° C., the tracing indicates growth of line intensities at 0.279 and 0.343 rim, and weak peaks at 0.307, 0.315, and 0.360 nm. Since the former two intense lines represent the presence of a relatively large amount of $\gamma$-$Zn_3(PO_4)_2$, it appears that heat treatment at 500° C. promotes $\alpha \rightarrow \gamma$ phase transition processes. Based upon the above information, a summary of the phase transition of $Zn_3(PO_4)_2.2H_2O$ at temperatures up to 500° C. is given in Table 2.

TABLE 2

| Phase Changes In Conversion Coating vs Ecorr | | | |
|---|---|---|---|
| Temperature | Phase | | $E_{corr}$* |
| °C. | Major | Minor | Volt |
| 100 | $Zn_3(PO_4)_2.2H_2O$ | — | −0.573 |
| 200 | $Zn_3(PO_4)_2.2H_2O$ | — | −0.572 |
| 300 | $\alpha$-$Zn_3(PO_4)_2$ | $\gamma$-$Zn_3(PO_4)_2$ | −0.572 |
| 400 | $\alpha$- and $\gamma$-$Zn_3(PO_4)_2$ | — | −0.600 |
| 500 | $\gamma$-$Zn_3(PO_4)_2$ | $\alpha$-$Zn_3(PO_4)_2$ | −0.657 |

*in aerated 0.5 M NaCl solutions.

Electrochemical corrosion tests were performed to investigate how various conversion phases affect ability of crystal coatings to protect steel from corrosion. This protective ability was estimated by making comparisons between the corrosion potential, $E_{corr}$, values obtained from the potential axis at the transition point from the cathodic to anodic sites on the electrochemical polarization curves. As summarized in Table 2, no appreciable changes in the $E_{corr}$ value for samples treated at temperatures up to 300° were observed. A shift in $E_{corr}$ to a more negative site occurred when the samples were baked at 400° C., indicating that hybrid layers of $\alpha$-$Zn_3(PO_4)_2$ and $\gamma$-$Zn_3(PO_4)_2$ have less corrosion resistance. A further increase in treatment temperature to 500° C. resulted in a significant reduction in $E_{corr}$. The corrosion-protective ability of the Zn.Ph layers is dependent upon the extent of the conversion from the a phase to the $\gamma$ phase, but independent of the dehydration and elimination of crystallized water in the Zn.Ph layers which occurs at a temperature of approximately 300° C. in air. One possible reason for poor protective behavior of Zn.Ph layers containing the $\gamma$ phase is increased porosity of the crystal layers.

Figure 13:
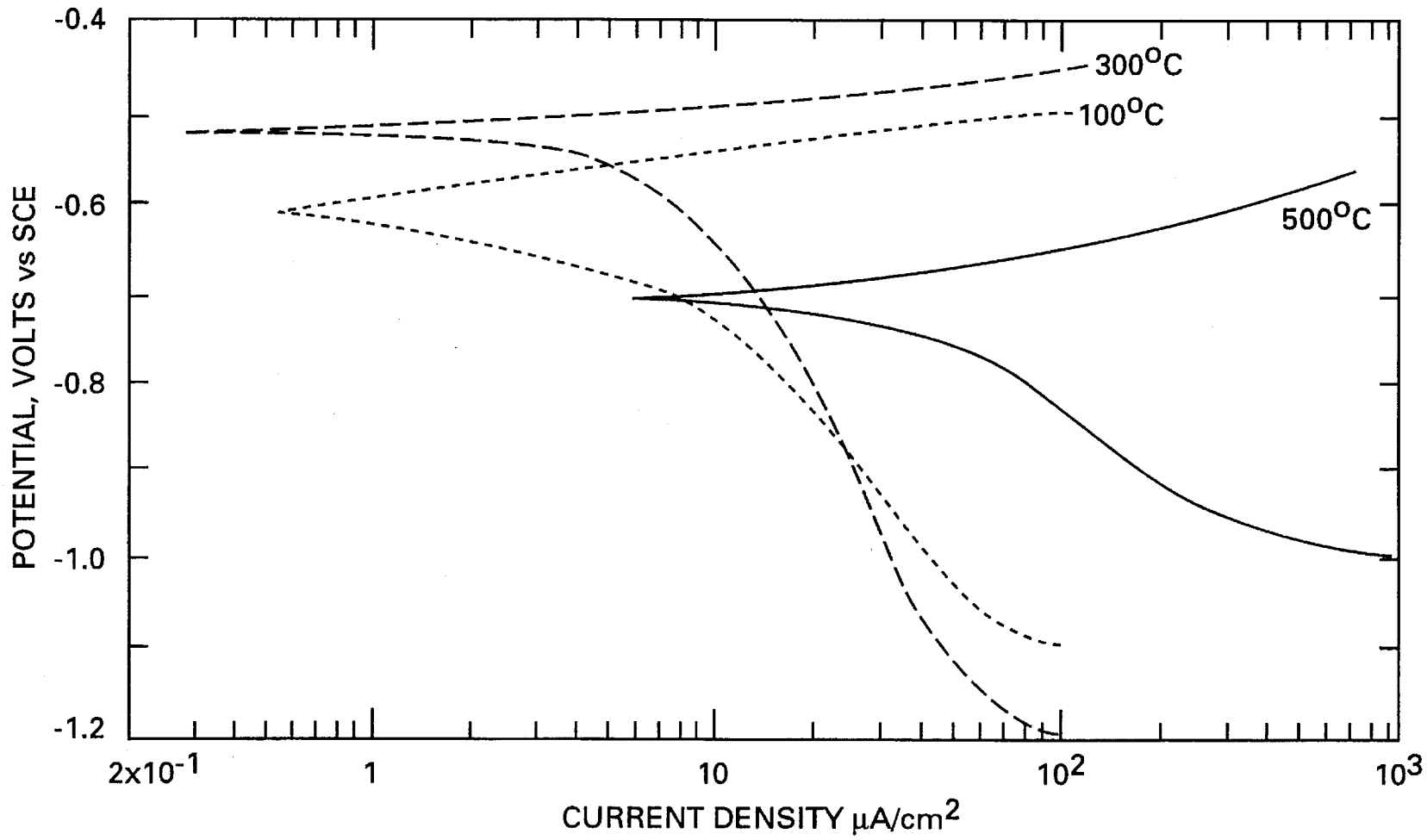
FIG. 13 shows polarization curves for 100°- , 300°-, and 500° C.-treated zinc phosphated steels after immersion in 0.1M NaOH.
Figure 14B:
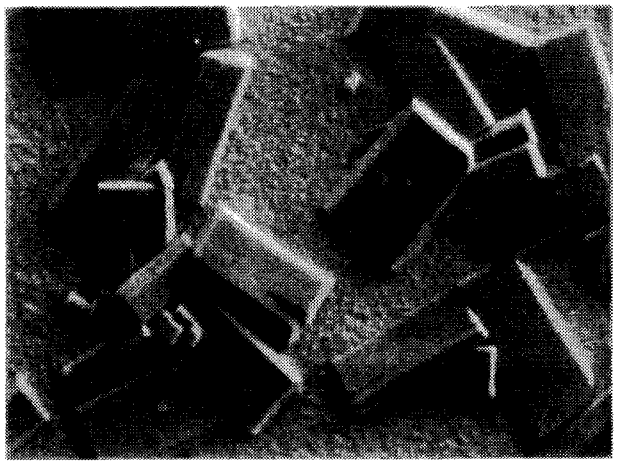
FIGS. 14(*a*)–(*d*) show SEM micrographies of zinc phosphate crystals derived from unmodified phosphating isolation by varying the immersion times; 1 min (a), 5 min (b), 20 min (c), and 30 min (d).
Figure 14D:
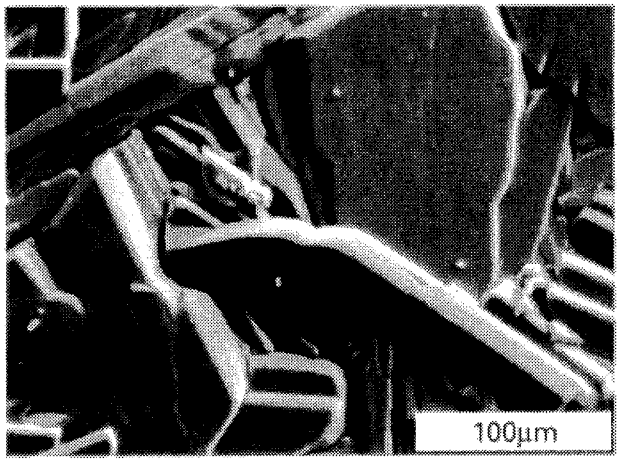
Figure 14A:
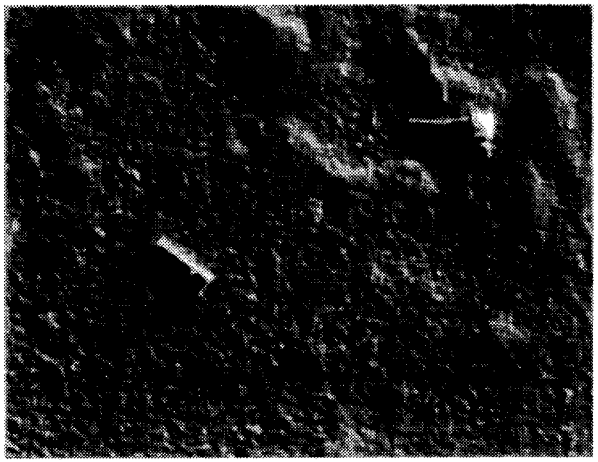
Figure 14C:
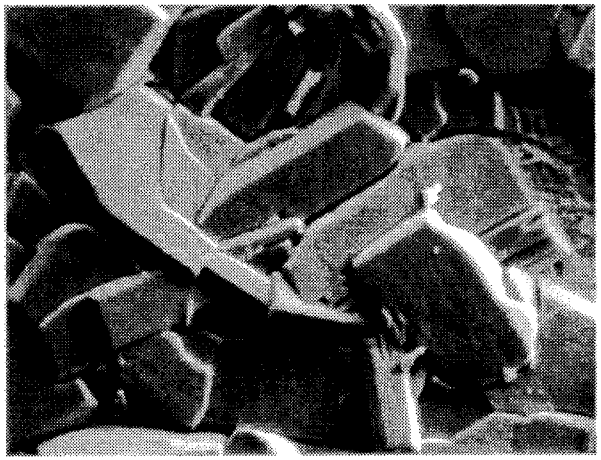
Figure 15A:
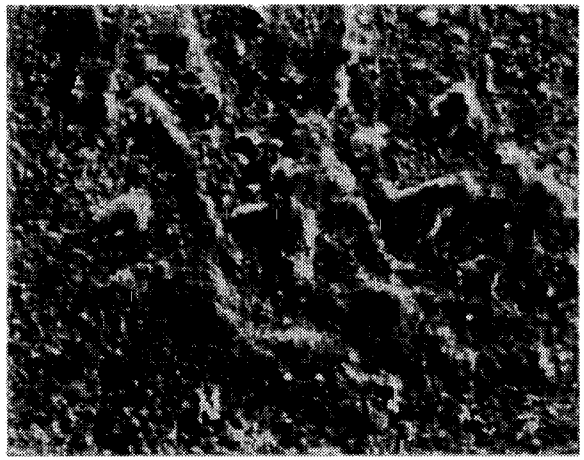
FIGS. 15 (*a*)–(*d*) show scanning-electron-microscope micrographs of test panels of electrogalvanized steel immersed in a preferred cobalt-nitrate-containing test zinc-phosphating solution of the invention as a function of immersion time.
Figure 15B:
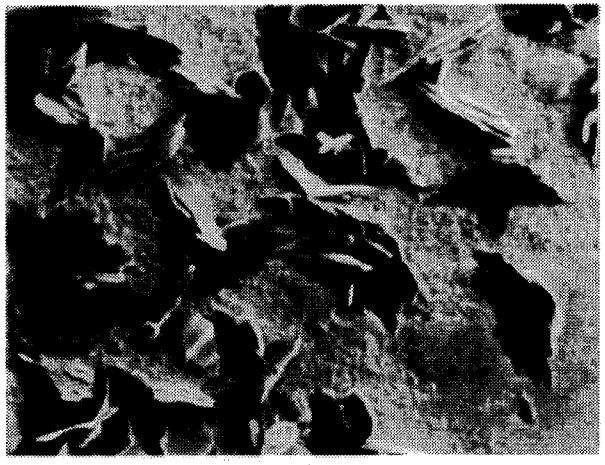
Figure 15C:
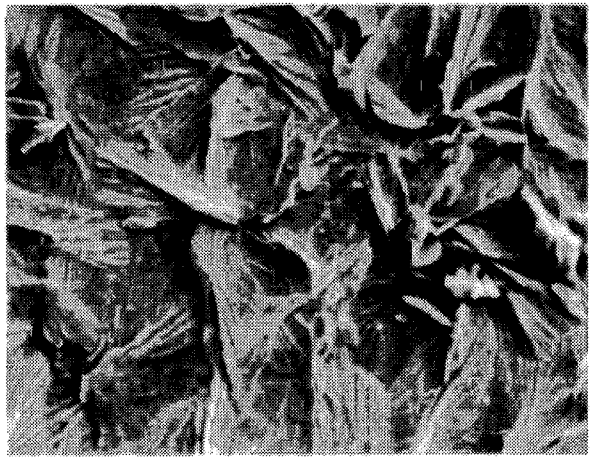
Figure 15D:
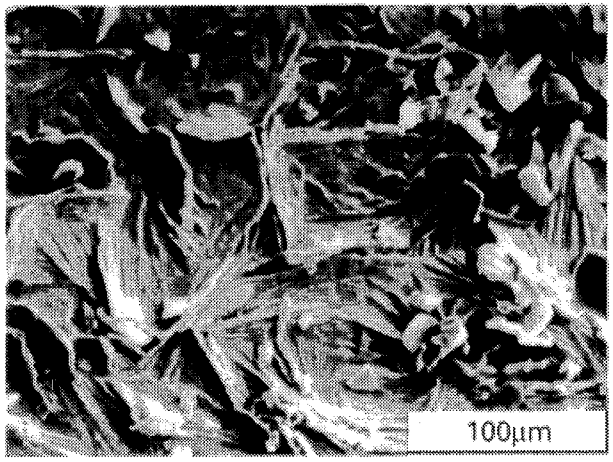

Polarization curves for 100°-, 300°- and 500° C.-treated samples after exposure to a 0.1M NaOH solution for 1 hr are given in FIG. 13. The shape of the curves represents the transition from cathodic polarization at the onset of the most negative potential to the anodic polarization curves at the end of lower negative potential. The potential axis at the transition point from cathodic to anodic curves is normalized as the corrosion potential, $E_{corr}$. These polarization behaviors were determined in anaerated 0.5M NaCl solution at 25° C. Comparisons of cathodic polarization areas for 300°- and 500° C.-treated samples with that for 100° C.-treated sample indicated the following: (1) at 500° C., short-term steady-state current value in the potential region between −1.0 and −1.1 V is considerably higher, (2) heat treatment at 300° C. shifts $E_{corr}$ to a more positive site and decreases current density at the potential axis, and (3) treatment at 500° C. decreases $E_{corr}$ and enhances current density in the vicinity of $E_{corr}$. Although the 500° C.-treated Zn.Ph is less susceptible to alkaline dissolution, higher current density (observation No. 1 above) is indicative of high oxygen reduction kinetics which occur under the coating. A coating offering poor protection would be expected to display a lower $E_{corr}$ and a higher current density (in agreement with observation No. 3). With regards to observation No. 2, conversion to an anhydrous a phase at 300° C. yields a more stable layer and inhibits the oxygen reduction reaction. This appears to relate directly with the low-rate of alkaline dissolution.

EXAMPLE 7

Zinc Phosphate Conversion Coating Used on Rolled Steel

The following advanced zinc phosphate (Zn.Ph) conversion coatings possess good corrosion-protection performance (salt spray resistance >400 hr at 90° F.), thermal stability at temperatures up to 400° C., and may be deposited on cold-rolled steel surfaces. These zinc phosphating formulations contain free Fe ions of 3.0±0.5 ppm. Two formulations are listed in Table 3.

TABLE 3

| Formulation and Preparations of Zn.Ph Solutions Containing Free Fe Ions of 3.0 ± 0.5 ppm | |
|---|---|
| Material | wt % |
| Formulation 1 | |
| $Zn_3(PO_4)_2.2H_2O$ | 4.6 |
| 85% $H_3PO_4$ water | 9.2 |
| 25% p(AA) having molecular weight (M.W.) 60,000 | 2.0 |
| $Co(NO_3)_2.6H_2O$ | 1.00 |
| Water | 83.2 |
| Formulation 2 | |
| $Zn_3(PO_4)_2.2H_2O$ | 4.6 |
| 85% $H_3PO_4$ water | 9.2 |
| 25% p(AA) M.W. 60,000 | 2.0 |
| $Ni(NO_3)_2.6H_2O$ | 1.0 |
| Water | 83.2 |

Preparation

After mixing all chemical components, the solution is preferably stored at room temperature for a minimum of 18 hours, then modified by incorporating Fe ions of 3.0±0.5 ppm. Incorporation of free Fe ions into Zn.Ph solution is accomplished by immersing small steel panels of Fe-releasable sacrificed metal in the solution at 80° C. The Fe-modified solution is preferably stored at 80° C. for 20 hours prior to use, the mechanism for the role of Fe ions is explored in more detail in T. Sugama and N. R. Carciello, *J. Appl. Polymer Sci.*, 45:1291–1301 (1992), the contents of which are herein incorporated by reference.

Table 4 shows effects of various concentrations of free Fe ion on salt spray resistance (ASTM B117) of Zn.Ph-deposited steels. Free Fe ions in the content ranges of ~2.4 to ~5.6 ppm are preferably incorporated into the basic formulations, to obtain a Zn.Ph coating providing excellent salt spray resistance (>400 hr at 90° F.).

TABLE 4

| Effect of Free Fe Concentrations on Salt Spray Resistance of Zn.Ph-Deposited Steels | | |
|---|---|---|
| Formulation | ppm | hr |
| 1 | 0.0 | 24 |
| 1 | 0.8 | 72 |
| 1 | 1.6 | 150 |
| 1 | 2.4 | 460 |
| 1 | 3.2 | 480 |
| 1 | 4.0 | 470 |
| 1 | 4.8 | 460 |
| 1 | 5.6 | 430 |
| 1 | 6.4 | 200 |
| 2 | 0.0 | 24 |
| 2 | 0.8 | 50 |
| 2 | 1.6 | 100 |
| 2 | 2.4 | 410 |
| 2 | 3.2 | 405 |
| 2 | 4.0 | 400 |
| 2 | 4.8 | 420 |
| 2 | 5.6 | 400 |
| 2 | 6.4 | 120 |

Table 5 shows the effect of elapsed time after incorporation of Fe ions in phosphating solution on the salt spray resistance, implying that the Fe ion-modified phosphating solution is best stored at 80° C. for 20 hr prior to use.

TABLE 5

Effect of Elapsed Times at 80° C. after Incorporation of Fe Ion in Solution on the Salt Spray Resistance

| Formulation | Free Fe Ion ppm | Salt spray resistance, hr Elapsed times after incorporation of Fe in solution 1 hr | 2 hr | 5 hr | 10 hr | 20 hr | 40 hr |
|---|---|---|---|---|---|---|---|
| 1 | 4.0 | 72 | 100 | 150 | 200 | >400 | >400 |
| 2 | 4.0 | 48 | 96 | 120 | 180 | >400 | >400 |

EXAMPLE 8

Ability of mild carbon steel treated with a transition metal modified conversion solution and top coated with a high temperature polymer, to resist gas furnace exhaust gases and condensates A series of 16 mild carbon steel tubes of 0.625 in. outside diameter and 16 gauge wall thickness were degreased and then oven dried at 80° C. The tubes were then rinsed in water and oven cured at 150° for 30 min.

A polyphenylene sulfide topcoat was then applied to the outer surfaces of the tubes by dipping the tubes into a polymerisopropyl alcohol slurry at 25° C. and then curing in an oven at ≧300° C.

The coated tubes were then exposed for 60 days to conditions simulating a typical residential high efficiency gas furnace. The gas stream contained 26 parts per million (ppm) chloride and 5 ppm fluoride with an inlet temperature of 210° C. and the exit temperature of 40° C. Since the exit temperature was below the dew point, samples were exposed to a variety of environments ranging from dry to completely wet with condensate, exposure visual and metallographic examinations, and mechanical testing showed no discernable degradation.

EXAMPLE 9

Treatment of Electrogalvanized Steel

Test panels of ASE 1006 cold-rolled steel coated with electroplated zinc designated "Ford E 60 Electrozinc 60 G" were obtained from Advanced Coating Technologies, Inc. Two zinc-phosphating solutions were prepared: a preferred cobalt-nitrate-containing test solution of the invention and a reference solution. The composition of the two solutions are set forth in Table 6 below.

TABLE 6

| Component | Test Solution (Parts by Weight) | Reference Solution (Parts by Weight) |
|---|---|---|
| Zinc orthophosphate tetrahydrate | 4.7 | 4.7 |
| $H_3PO_4$ | 9.3 | 9.3 |
| Approximately 25% by weight aqueous colloidal solution of poly(acrylic acid) | 2.0 | 2.0 |
| $Co(NO_3)_2.6H_2O$ | 1.0 | — |
| Water | 84.0 | 84.0 |

The average molecular weight of the poly(acrylic acid) was approximately 60,000. The aqueous colloidal solution of poly(acrylic acid) was obtained from Rohm & Haas Co.

An immersion bath of the test solution and an immersion bath of the reference solution were prepared. The two immersion baths were maintained at approximately 80° C. The test panels of electrogalvanized steel were cleaned and, as noted below, immersed in one or the other of the cobalt-nitrate-containing test zinc-phosphating solution bath or the reference zinc-phosphating solution bath.

FIGS. 14 and 15 show scanning-electron-microscope micrographs of crystalline Zn.Ph coatings on test panels of an electrogalvanized steel obtained by immersion of the panels in the reference zinc-phosphating solution and the cobalt-nitrate containing test zinc-phosphating solution, respectively, as a function the length of immersion time. With the reference solution, the precipitation of rectangular-shaped Zn.Ph crystals on the surface of electrogalvanized steel occurred slowly. The scanning electron microscope image of a specimen made after immersion for about 1 minute revealed a random distribution of rectangular-shape Zn.Ph crystals over the surface of the electrogalvanized steels as shown in FIG. 14(*a*). An increase in immersion time to about 5 minutes led to an extensive coverage of Zn.Ph on the electrogalvanized steel surface, while the size of crystals grew significantly, as may be seen in FIG. 14(*b*). An essentially complete coverage of fully grown crystals was attained after an immersion time of about 30 minutes in the reference solution, as shown in FIG. 14(*d*). In contrast, the cobalt-nitrate-containing test solution was effective in causing rapid deposition of the Zn.Ph layers on surfaces or electrogalvanized steel. FIG. 15(*b*) shows that growth of lameliar-like crystals could be observed after immersion of a test panel in the test solution for only about 2 seconds, which can be compared with the surface texture of the electrogalvanized steel treated by immersion in the test solution for about one second shown in FIG. 15(*a*). Immersion for about 5 seconds in the cobalt-nitrate-containing test zinc-phosphating solution was sufficient to produce dense conversion coatings over the entire substrate surface, as may be seen in FIG. 15(*c*). A further extension of immersion time to about 10 seconds produced a densely packed conformation of lamellar Zn-Ph crystals as shown in FIG. 15(*d*), reflecting that the electrogalvanized steel surface had essentially been altered and now had a rough microstructure. The morphological and topographical characteristics of such crystals produced by the cobalt-nitrate containing test solution were quite different from those of the crystal layers induced by the reference solution.

Figures 16A, 16B, 16C:
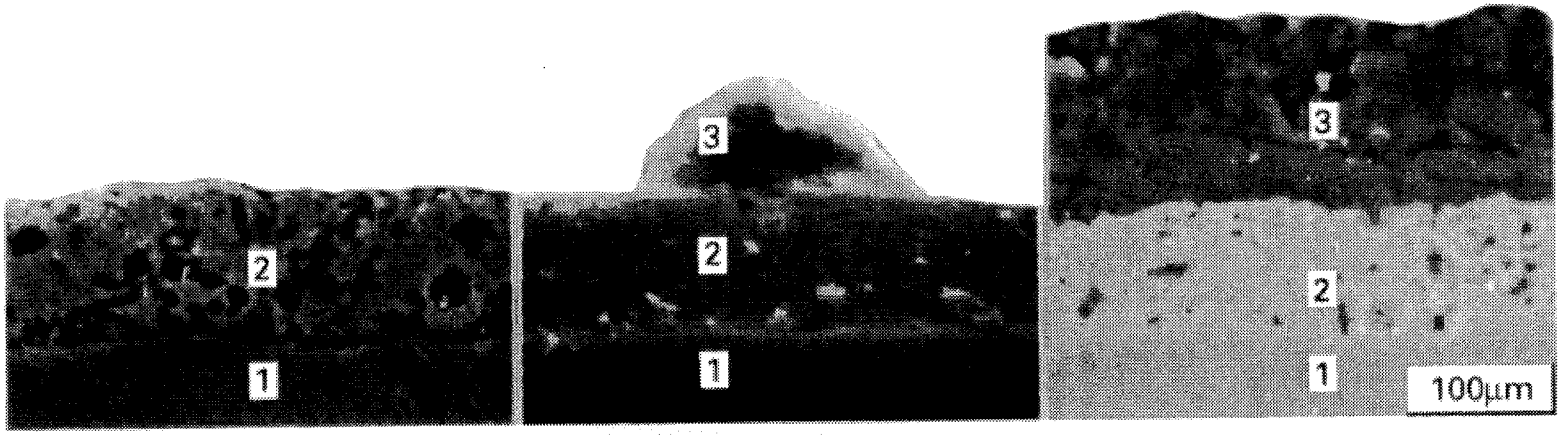
FIGS. 16 (*a*)–(*c*) show respectively scanning-electron-microscope micrographs of cross sections of "as-received" control specimens of electrogalvanized steel of test specimens of electrogalvanized steel and of test specimens of electrogalvanized steel which had been immersed in a cobalt-nitrate-containing test zinc-phosphating solution.
Figure 16E:
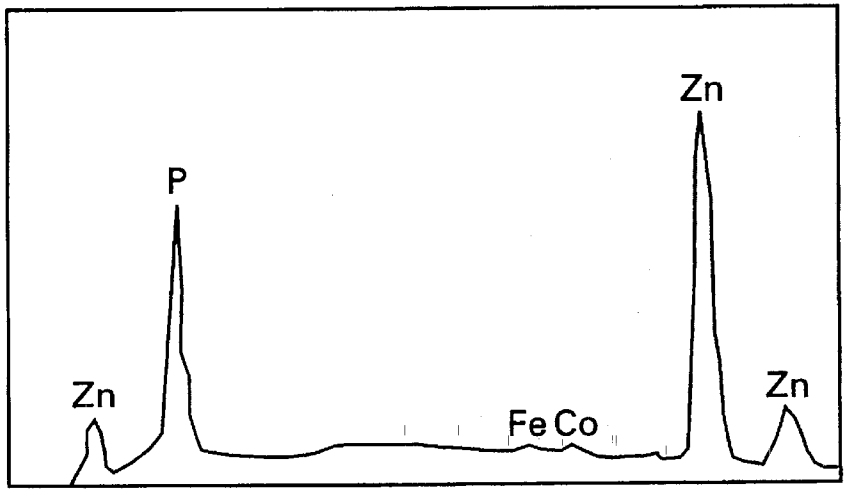
Figure 16D:
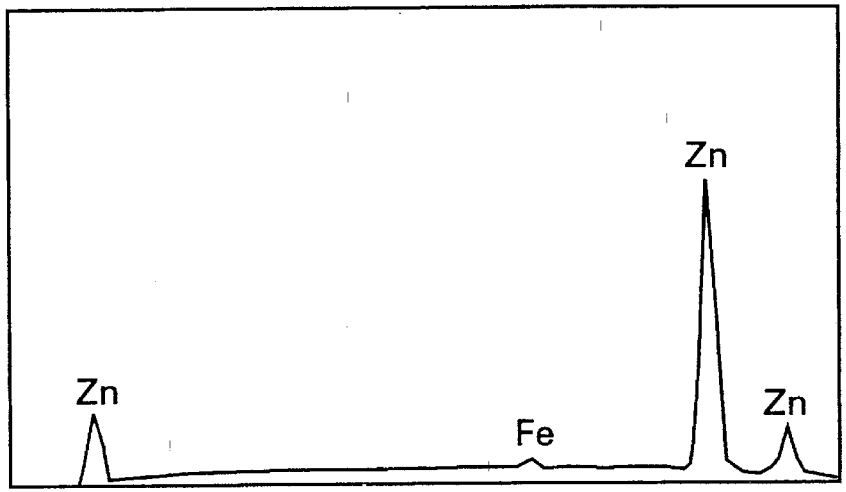

Cross sections through electrogalvanized steel surfaces which had been untreated on the one hand and which had been treated with a zinc-phosphating solution of the invention on the other were examined by scanning electron microscopy and by energy-dispersive x-ray spectrometry, as shown in FIG. 16. A scanning-electron-microscope image of a cross section of the untreated "as-received" electrogalvanized steel of FIG. 16(*a*) showed that the electroplated zinc layer denoted as the "2" layer had a thickness of about 10 μm and was evidently porous. The layer denoted as the "1" layer was the underlying steel layer. AS may be seen in an energy-dispersive x-ray spectrum of the "2" layer of FIG. 16(*d*), there was iron as well as zinc in the porous electroplated zinc layer. Since the source of the iron would have been the steel, iron had evidently migrated from the steel to the matrix of pure zinc during the electroplating processes. FIG. 16(*b*) gives a scanning electron microscope image of a cross-section through the Zn.Ph surface of a test panel immersed for about 2 seconds in the cobalt-nitrate-containing test zinc-phosphating solution. By comparison with the cross-sectional image of the "as-received" electrogalvanized steel of FIG. 16(*a*), the image indicated that an additional phase, denoted as "3," was superimposed on the electrogalvanized steel surface. The energy-dispersive x-ray spectra of this superimposed layer shoved the presence of zinc and phosphorous as the principal components, and iron and cobalt as minor ones. Because Zn.P, and co reflected the formation of a cobalt-modified Zn.Ph, it is apparent that the partial deposition of a cobalt-modified Zn.Ph layer onto electrogalvanized steel occurred in approximately the first 2 seconds of immersion. The complete coverage of a cobalt-modified Zn.Ph layer of about 12 μm thick wan recognizable on the scanning electron micrograph images of specimens after immersion for about lo seconds. The images also suggested that the thickness of the zinc layer was reduced from about 10 μm in the original phase to about 8 μm after coating with Zn.Ph. Such a decrease in thickness at the zinc layer may be due to dissolution of the layer caused by the attack of phosphating solution on electrogalvanized steel surface. Although damage of the zinc layer tended to occur at interface between the cobalt-modified Zn.Ph layer and the electrogalvanized steel, no layer separation and segregation was observed on close examination of scanning electron microscope images in the Zn.Ph/Zn boundary regions (not shown). The lack of layer separation and segregation suggested that the adhesive bond of the cobalt-modified Zn.Ph to Zn was good.

Figure 17:
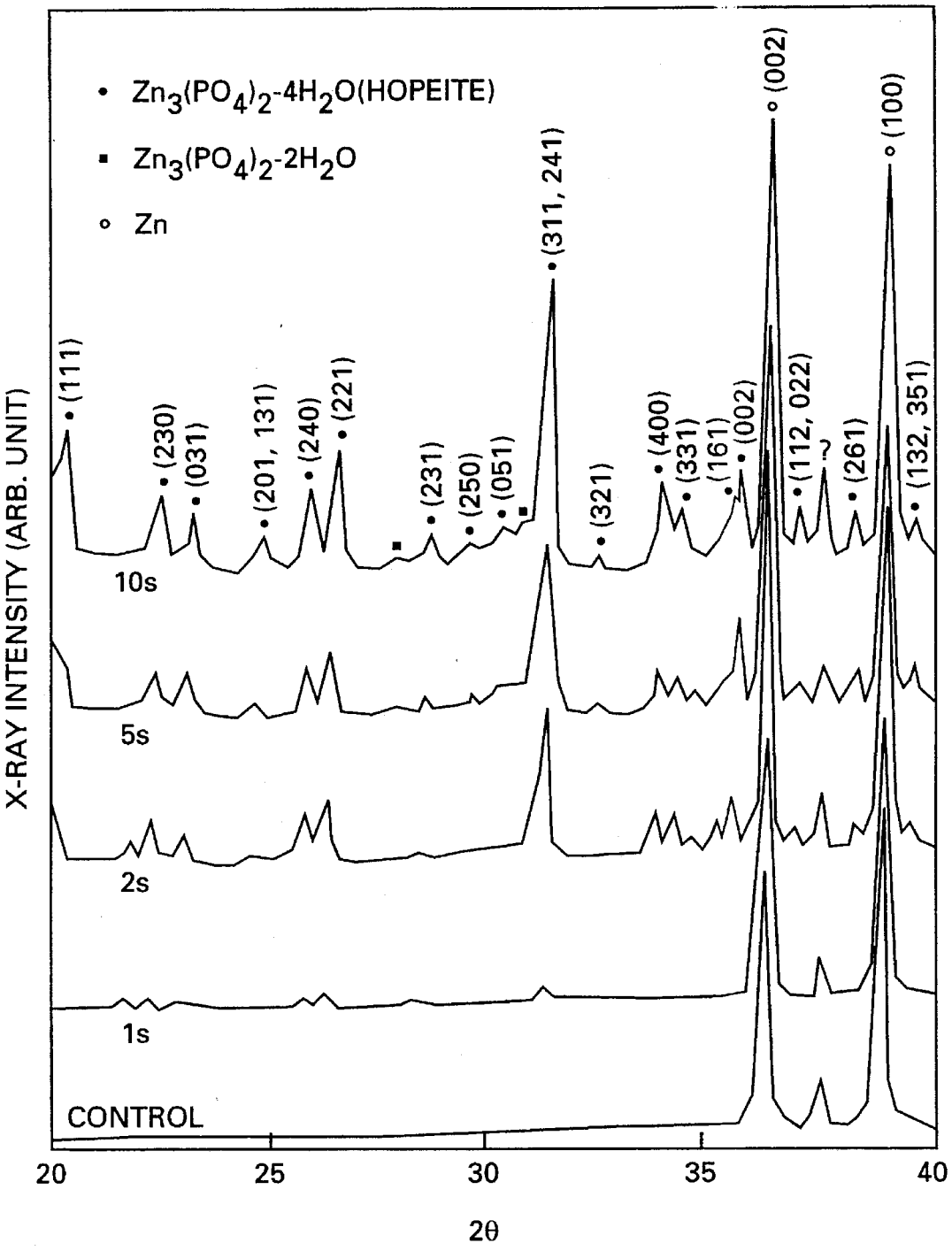
FIG. 17 shows x-ray diffraction traces of an "as-received" control test panel of electrogalvanized steel and test panels of electrogalvanized steel immersed in a preferred cobalt-nitrate-containing test zinc-phosphating solution of the invention.

FIG. 17 illustrates the x-ray diffraction tracings ranging from about 0.444 to about 0.225 nm of an "as-received" electrogalvanized steel test panel as a control and of the cobalt-modified Zn.Ph coatings prepared by immersing test panels of electrogalvanized steels for approximately 1, 2, 5, and 10 seconds in the preferred cobalt-nitrate-containing test zinc-phosphating solution of the invention. The x-ray diffraction pattern of the control showed the presence of only a single phase corresponding to a pure zinc crystal. Although the intensity of that x-ray diffraction was weak, the Zn.Ph conversion products formed on electrogalvanized steel after immersion for about 1 second can be identified as a hopeits phase: $Zn_3(PO_4)_2.4H_2O$. The intensity of the hopeits lines markedly increased with an increased immersion time, while the strong lines of the underlaying zinc phase remained present in the x-ray diffraction pattern. The data also indicated that zinc orthophosphate dihydrate, $Zn_3(PO_4)_2.2H_2O$ coexisted as minor phase with the hopeits. Similar phase compositions were identified from the unmodified Zn.Ph coatings prepared by immersing electrogalvanized-steel test panels for about 30 minutes in the reference zinc-phosphating solution; namely, the conversion coatings consisted of a hopeits phase as a principal phase and $Zn_3(PO_4)_2.2H_2O$ as a minor phase.

X-ray photoelectron spectroscopy was used to investigate the changes in chemical composition of the surfaces of Zn.Ph coatings from the reference zinc-phosphating solution and the cobalt-nitrate-containing test zinc-phosphating solution as a function of immersion time. The results are summarized in Table 7 below.

TABLE 7

Surface Atomic Composition versus Immersion Time in Reference Solution and Cobalt-nitrate Containting Test Solution.

| Solution | Time, sec | Atomic Concentration, % | | | | |
|---|---|---|---|---|---|---|
| | | P | C | O | Zn | P/Zn |
| Control | — | — | 46.6 | 39.4 | 14.0 | 0.0 |
| Reference | 60 | 0.9 | 49.7 | 38.0 | 11.4 | 0.1 |
| Reference | 300 | 1.1 | 37.3 | 50.1 | 11.5 | 0.1 |
| Reference | 600 | 4.7 | 35.4 | 42.1 | 17.8 | 0.3 |
| Reference | 1200 | 6.9 | 37.2 | 43.1 | 12.8 | 0.5 |
| Reference | 1800 | 7.2 | 33.6 | 48.0 | 11.2 | 0.6 |
| Test | 1 | 1.2 | 57.7 | 30.8 | 10.3 | 0.1 |
| Test | 2 | 3.7 | 29.6 | 49.5 | 17.2 | 0.2 |
| Test | 5 | 12.0 | 20.5 | 60.6 | 6.9 | 1.7 |
| Test | 10 | 11.9 | 21.6 | 57.2 | 9.3 | 1.3 |

For "as-received" electrogalvanized steel, the principal elements occupying the outermost surface sites were carbon and oxygen, and the concentration of zinc was about 14.0%. Assuming that carbon reflected the presence of organic contaminants, the zinc and oxygen atoms presumably corresponded to the formation of zinc oxide as a passivating film on electrogalvanized steel surfaces. Such a film would be expected to retard the precipitation of embryonic Zn.Ph crystals on an electrogalvanized steel surface. In fact, using the reference phosphating solution, the percentage of phosphorous atoms was found to be only about 0.9% in approximately the first 60 seconds of immersion. Even when the immersion period was prolonged to approximately 300 seconds, there was no significant change in the concentration of phosphorous. This finding verified that the passivating layer of ZnO tends to inhibit the precipitation of Zn.Ph. Breakage of this passivating film seemed to occur when the electrogalvanized steel was immersed for approximately 600 seconds, because the concentration phosphorous was observed to increase markedly. Thus, a phosphorous content of 7.2%, corresponding to a phosphorous-to-zinc ratio of about 0.6, was observed after an immersion of approximately 1800 seconds. In the case of Zn.Ph coated test panels, the source of carbon was not solely carbon contamination, but also carbon in the poly(acrylic acid) present in the reference and test zinc-phosphating solutions and absorbed to the electrogalvanized steel and Zn.Ph surfaces during the conversion reaction. Oxygen, ranging from about 38.0 to about 30.1% for the Zn.Ph coated test panels of electrogalvanized steel, may be attributed to a number of compounds such as ZnO, Zn.Ph, organic contaminants, and poly(acrylic acid).

With the cobalt-nitrate-containing test zinc-phosphating solution, an immersion tame of only about 5 seconds resulted in the formation of conversion coatings having a phosphorous concentration of less than about 10.0%. Beyond about 5 seconds, the concentration of phosphorous tended to level off. The phosphorous concentration data tended to support the findings from the scanning-electron microscope image analysis of FIGS. 16 and 17; namely, that Zn.Ph essentially completely covered electrogalvanized steel after about 5 seconds. The data also indicated that the phosphorous-to-zinc ratio of the cobalt-modified Zn.Ph coating made by a 5-second immersion in the test solution was significantly higher than the phosphorous-to-zinc ratio from an approximately 1800 second immersion in the reference solution, which implies that the Zn.Ph coating from the cobalt-nitrate-containing test solution gave rise to a surface layer which was enriched in phosphates.

Figure 18:
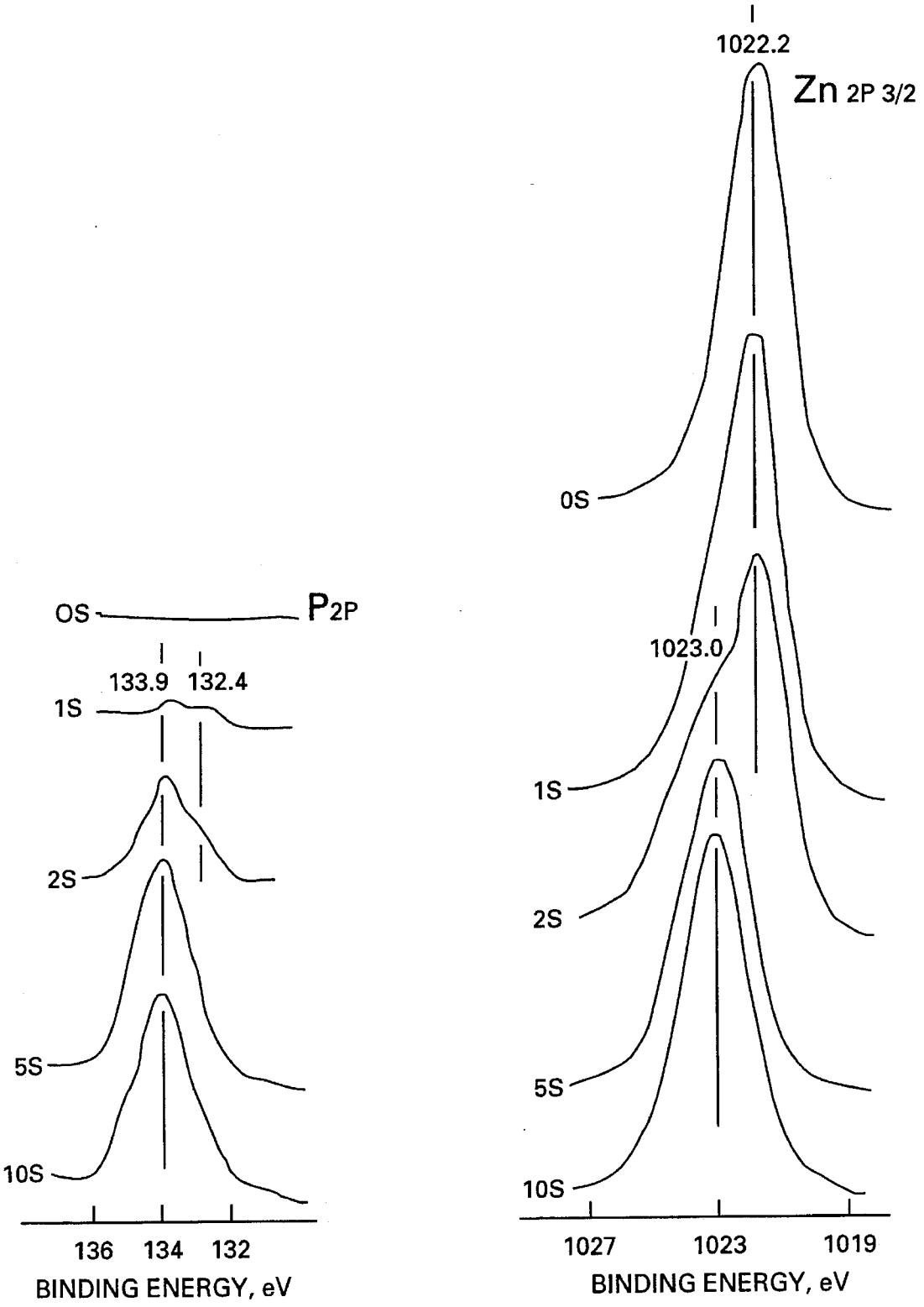
FIGS. 18*a*, 18*b* and 19 respectively show high-resolution x-ray photoelectron spectra of $P_{2p}$ and $Zn_{2p3/2}$, and $C_1$, core-level excitatrons of Zn.Ph coatings as a function of treatment time in a preferred cobalt-nitrate-containing test zinc-phosphating solution of the invention.
Figure 19:
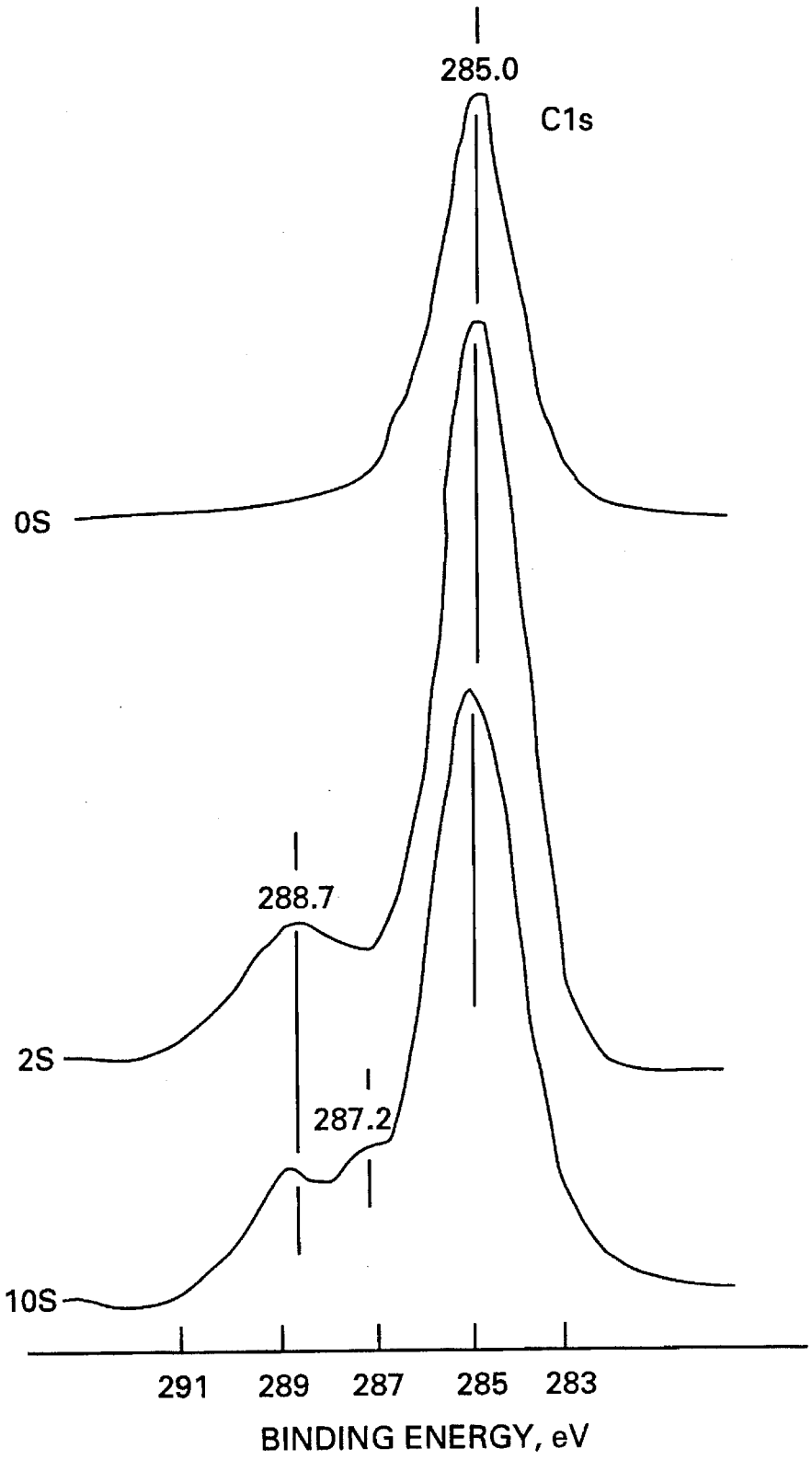

FIGS. 18 and 19 show the high-resolution x-ray photoelectron spectra of $P_{2p}$, $Zn_{2p3/2}$, and $C_{1s}$, core-level excitations from Zn.Ph coatings produced by immersion in the cobalt-nitrate-containing test zinc-phosphating solution as a function of immersion time. In the $P_{2p}$ region shown in FIG. 18, no peak was found on "as-received" electrogalvanized steel, which was denoted as "0S" in FIG. 18. The coating made by immersion in the test solution for about 1 second (denoted "1S") exhibited two weak peaks, at about 133.9 and about 132.4 eV. The higher energy peak presumably reveals the phosphorous originating from the Zn.Ph, and the lower energy may be due to the formation of a zinc dihydrogen othrophosphate, $Zn(H_2PO_4)_2.xH_2O$. The intensity of peak at about 133.9 eV markedly increased with an increased immersion time, while the peak at about 132.4 eV essentially vanished. The degree of coverage of Zn.Ph over electrogalvanized steel can be confirmed by comparing the spectral features of the $Zn_{2p3/2}$ region shorn in FIG. 18. The single peak at the BE position of about 1022.2 eV for the "as-received" electrogalvanized steel (0S) was due to zinc in the ZnO layers, forming on the surface of the galvanized coatings. The $Zn_{2p3/2}$ curve of the specimens treated fur approximately 2 seconds—denoted "2S" in FIG. 18—is distinctive; an additional weak line at about 1023.0 eV appears in the spectrum, separate from the main line. The intensity of this new line dramatically increased as the treatment time was prolonged. After treatment for about 5 seconds—as shown the curve designates "5S"—the peak at about 1023.0 eV essentially became the principal lane, while the line at about 1022.2 eV, originating from the zinc in ZnO, essentially disappeared. Because the peak at about 1023.0 eV evidently belonged to Zn originating from Zn.Ph, this result strongly supported the scanning-electron-microscope images showing that an immersion in the cobalt-nitrate-containing test solution for about 5 seconds was long enough to cover essentially the entire surface of electrogalvanized steel with Zn.Ph.

Turning now to FIG. 19, the $C_{1s}$, region of the untreated electrogalvanized steel surfaces had a symmetrical peak at about 285.0 eV, reflecting the carbon in the hydrocarbon contaminant "$CH_a$", as shown in the curve denoted "0S". When the electrogalvanized steel surface was treated with the test zinc-phosphating solution for about 2 seconds, the $C_{1s}$, spectrum revealed two resolvable Gaussian components at about 285.0 eV, attributable to carbon of the hydrocarbon in the organic contaminant and to hydrocarbon carbon in the backbone chain of poly(acrylic acid). A second peak emerged at about 288.7 eV corresponded to carbon originating from the carboxylic acid, COOH, in the poly(acrylic acid). Increasing the immersion time to about 10 seconds showed the emergence of an additional peak at approximately 287.2 eV in the spectrum denoted "10S". This additional peak, emerging at the binding energy location between a carbonyl carbon, C=O, at approximately 288.0 eV and a carbon-oxygen single bond at approximately 288.5 eV can be assigned to the carbon in the $—COO^-—Zn^{2+}—^-OOC—$salt complex formation. Nevertheless, both the bulk and complexed poly(acrylic acid) polymers appear to be present at the outermost surface site of cobalt-modified Zn.Ph produced with the cobalt-nitrate-containing test zinc phosphating solution. Although the deposition of Zn.Ph was relatively poor, the presence of poly(acrylic acid) was also identified by x-ray photoelectron spectros copy on the electrogalvanized steel surfaces after immersion for about 60 seconds in the reference zinc-phosphating solution without cobalt nitrate.

Corrosion Resistance

Figure 20:
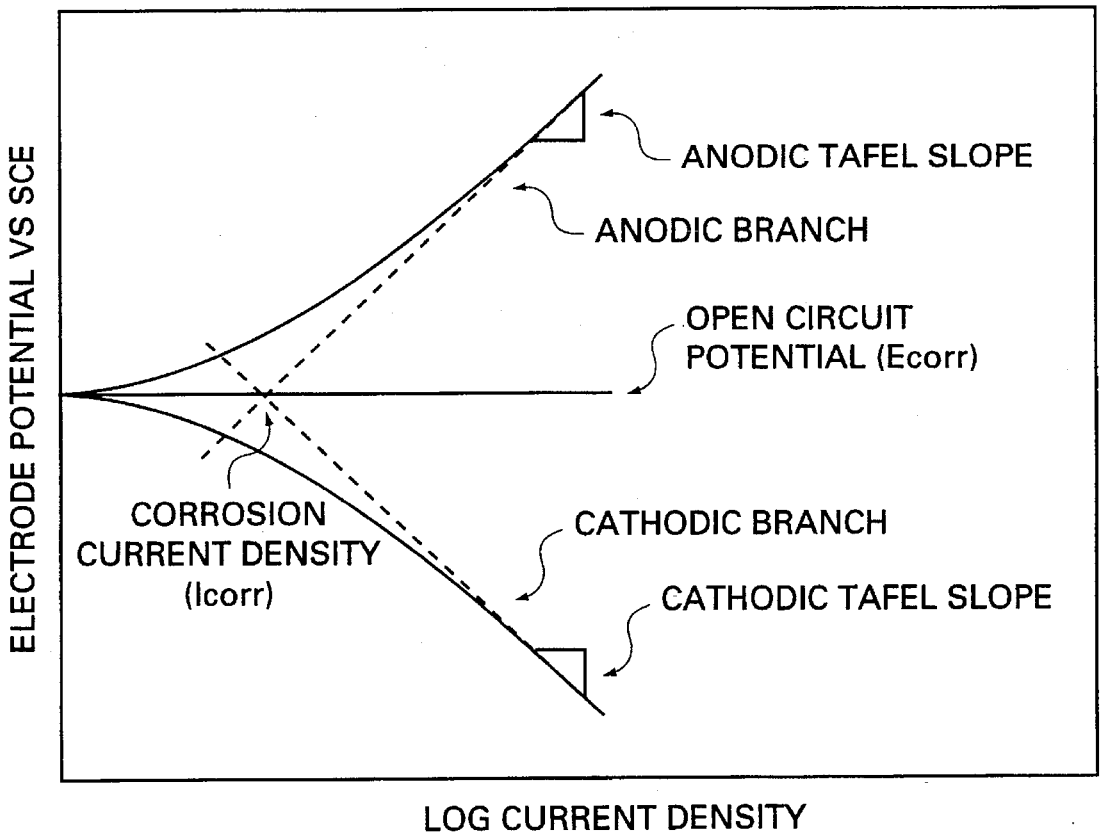
FIG. 20 shows cathodic-anodic polarization for an electrogalvanized steel test panel.

The corrosion resistance of Zn.Ph coated electrogalvanized steel was estimated from potentiodynamic polarization diagrams using the so-called "Tafel" extrapolation technique. FIG. 20 shows a typical cathodic-anodic polarization curve for an electrogalvanized steel test panel in which the polarization voltage (E) versus current (I) (Tafel plot) was plotted. Based upon this potentiodynamic polarization curve, the absolute corrosion rates of steel could be estimated. Corrosion rates are conventionally expressed in the engineering units of milli-inches per year (mpy). The following equation proposed by Sterm and Gery in *J. Electrochemcial Society*, vol. 104, pages 56 and following (1957) was used in a first step:

$$I_{corr}=\beta_a.\beta_c/\{2.303(\beta_a+\beta_c)R_p\}$$

where $I_{corr}$ is the corrosion current density in $\mu A/cm^2$, $\beta_a$ and $\beta_c$ with the units of volts/decade of current refer to the anodic and cathodic Tafel slopes (see FIG. 20), respectively, which were obtained from the log I vs E plots encompassing both anodic and cathodic regions, and $R_P$ is the polarization resistance which was determined from the corrosion potential, $E_{corr}$. When $I_{corr}$ is computed through the preceding equation, the corrosion rate (mpy) can be obtained from the following expression:

$$\text{Corrosion rate}=0.13\ I_{corr}\ (EW)/d,$$

where EW is the equivalent weight of the corroding species in g, and d is the density of the corroding species in $g/cm^3$.

Results for corrosion rates and $I_{corr}$ averaged over three specimens are set forth in Table 8 below.

TABLE 8

$I_{corr}$ and Corrosion Rate Obtained from Tafel Calculations for Zn.Ph-Coated Electrogalvanized Steel Produced by Immersion in the Reference Solution and the Cobalt-Nitrate-Containing Test Solution.

| Zinc phosphating Solution | Treatment time, sec | $I_{corr}$, $uA/cm^2$ | Corrosion Rate, mpy |
|---|---|---|---|
| Control | 0 | 6.65 | 3.04 |
| Test | 2 | 3.52 | 1.61 |
| Test | 5 | 4.19 | 1.91 |
| Test | 10 | 3.65 | 1.67 |
| Test | 20 | 4.06 | 1.85 |
| Test | 30 | 4.16 | 1.90 |
| Reference | 300 | 13.82 | 6.32 |
| Reference | 600 | 14.91 | 6.82 |
| Reference | 1200 | 7.11 | 3.25 |
| Reference | 1800 | 3.30 | 1.51 |

As may be seen in Table 8, the average corrosion rate for the "as-received" electrogalvanized steel test panels as control specimens was approximately 3.04 mpy,-corresponding to an averaged $I_{corr}$ of about 6.65 $\mu A/cm^2$. The average corrosion rate was significantly reduced by depositing the cobalt-modified Zn.Ph onto electrogalvanized steel surfaces from the cobalt-nitrate-containing test solution, as may be seen in Table 8. The corrosion rates for the specimens prepared by immersion in the cobalt-nitrate-containing test zinc-phosphating solution of between about 2 and about 30 seconds ranged from approximately 1.61 to approximately 1.91 mpy, corresponding to from about 52.9 to about 62.8% less than that of the untreated control. In contrast, the Zn.Ph coatings from the reference Zinc-phosphating solution appeared to give poor protection. As may be seen in Table 8, the average corrosion rates of the specimens immersed in the reference solution from about 300 to about 600 seconds were more than twice the average corrosion rate of the untreated control specimens. Relating this to the scanning electron microscope image analysis and the apparent dissolution of the zinc layer in electrogalvanized steel upon exposure to a zinc phosphating solution noted above in connection with FIG. 16, there appear to be two reasons for the high rate of corrosion in specimens which had been treated with the reference solution: one is the low rate of coverage by Zn.Ph over electrogalvanized steel and the other is the damage to the galvanized coating layers caused by an intensive anodic reaction, $Zn \rightarrow Zn^{2+}+2e^{-}$, during long-term immersion. Protection of electrogalvanized steel against NaCl-related corrosion was improved by immersing the specimens for 1800 seconds in the reference solution, suggesting that once the electrogalvanized steel surfaces were essentially completely covered with Zn.Ph, the Zn.Ph layer had a better protective performance than that of the untreated zinc coating itself.

Although zinc coatings are responsible for delaying the onset of "red rust" in galvanized steels, the attack of NaCl electrolyte on electrogalvanized steel surfaces promotes the rate of "white rust" formation. Such white rust generally represents a deterioration of the zinc layers of electrogalvanized steel. In general, improved corrosion protection appears to be obtained by increasing the thickness of the zinc layer of electro-galvanized steel. To evaluate the ability of cobalt-modified Zn.Ph coatings to inhibit the onset of white rust on electro-galvanized steel, test panels prepared by immersion for about 10 seconds in the cobalt-nitrate-containing test zinc-phosphating solution were exposed for up to seven days in a salt-water-spray chamber. For comparison, control test panels of the "as-received" electrogalvanized steel were also exposed to salt-water-spray in the chamber. White rust appeared on the control test panels after about four hours of exposure to the salt water spray. Subsequent exposure of the control test panels of up to seven days generated red rust, which implied that the underlying steel had been exposed by anodic dissolution of the zinc protective layers. By comparison, no sign of red rust was observed on the cobalt-modified Zn.Ph-coated electrogalvanized steel specimens exposed to salt water spray for the same time under essentially equivalent conditions. White rust was not observed to occur on the cobalt-modified Zn-Ph-coated electrogalvanized steel specimens until after exposure to the salt water spray for about 24 hours. The treatment of electrogalvanized steel surfaces by the cobalt-nitrate containing test zinc-phosphating solution thus significantly delayed the onset of white rust under exposure to salt-water spray.

Adhesion of Elastomeric Topcoat

Figure 21:
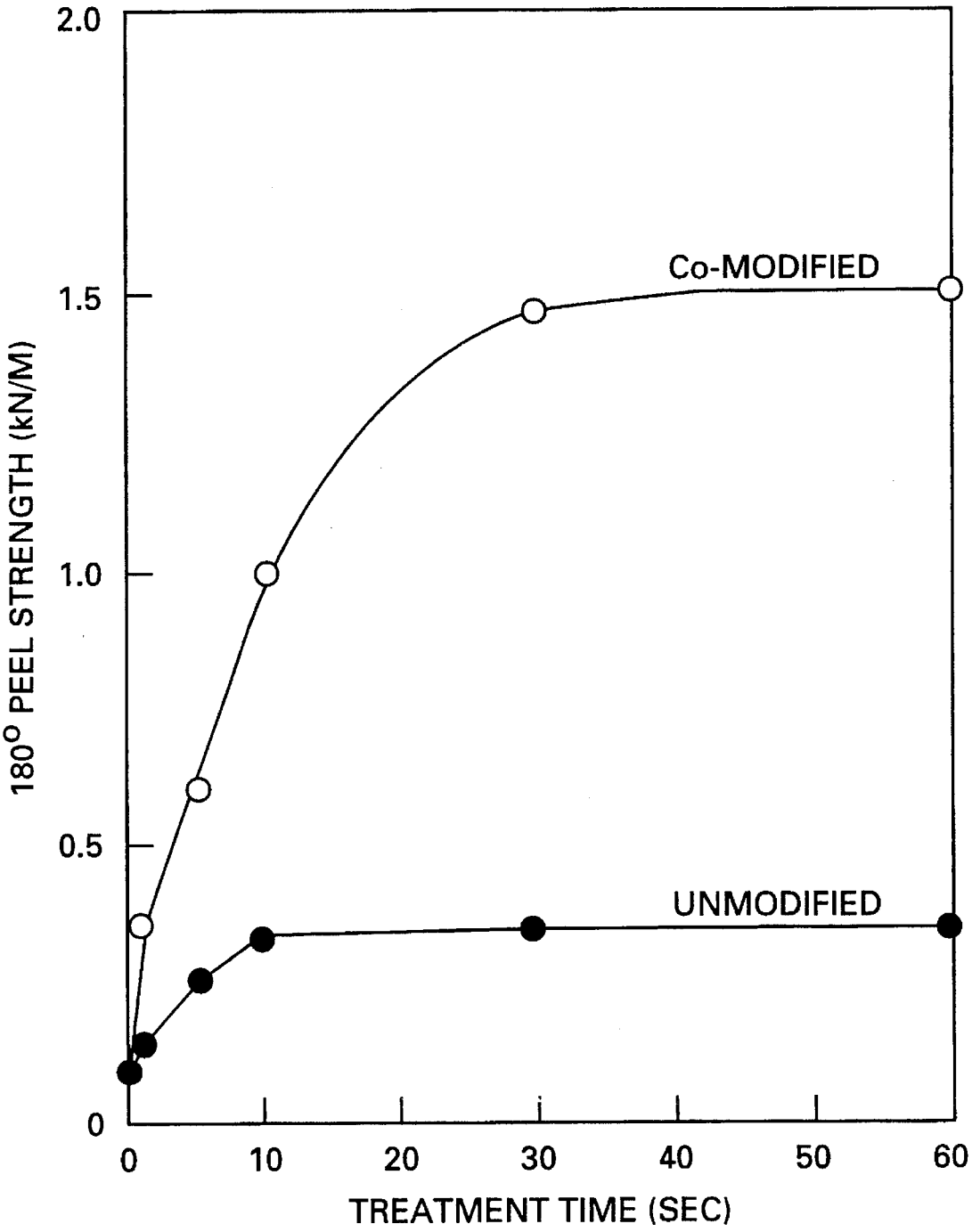
FIG. 21 shows the peel strength of a polyurethane topcoat film applied to test panels of electrogalvanized steel as a function of treatment time in a reference zinc-phosphating solution and in a preferred cobalt-nitrate-containing test zinc-phosphating solution of the invention.

Certain of the test panels of electrogalvanized steel were given an elastomeric topcoating. A polyester-modified polyurethane topcoat resin commercially available from the Lord corporation under the trade designation "M313 resin" was used for the topcoating. The polyurethane topcoat resin contained a proportion of silica as a filler. The polyurethane topcoat resin was polymerized by mixing with an approximately 50 percent by weight aromatic amino curing agent commercially available under the trade designation "M201" curing agent. The layer of topcoat on the test panels was cured in an oven at a temperature of about 80° C. The thickness of the polyurethane topcoat overlaid on the test panel5 was approximately 0.95 mm. The adherent properties of test panels of electrogalvanized steel bearing Zn.Ph coatings from the reference solution and the cobalt-nitrate-containing test solution to the polyurethane topcoat film were investigated by measuring the 180° -peel strength of the topcoat film overlaid on the Zn.Ph coatings. FIG. 21 shows the variations in peel strength at interfacial Joints between the polyurethane topcoat films and either the Zn.Ph coatings obtained from the reference solution or from the cobalt-nitrate-containing test solution as a function of the immersion time of the electrogalvanized steel test panels in the zinc-phosphating solutions. The average peel strength of polyurethane films removed from the "as-received" electrogalvanized steel surfaces, denoted in FIG. 21 as an immersion time of 0 seconds, was only about 0.09 kN/m, suggesting that the chemical and physical affinities of the electrogalvanized surfaces to the polyurethane topcoats were poor. The adhesion of polyurethane topcoat film substantially increased when the electrogalvanized steel surfaces were treated by the cobalt-nitrate-containing test zinc-phosphating solution. The observed average peel strength of approximately 1.47 kN/m for the polyurethane-topcoat-film-to-30-seconds-treated-electrogalvanzied-steel joints corresponded to an approximately fifteen fold improvement over that of polurethane-topcoat-film-to-untreated-electrogalvanized-steel joints. There was essentially no further gain in peel strength by immersing the test panels in the cobalt-nitrate-containing test solution for longer than about 30 seconds. The data of FIG. 21 also indicated that the surfaces of electrogalvanized steel treated by the reference zinc-phosphating solution for up to about 60 seconds only weakly adhered to the polyurethane topcoat films. Although crystal deposition was not seen on the surfaces treated for about 60 seconds with the reference zinc-phosphating solution, the development of a strength of about 0.35 kN/m was probably associated with a chemical reaction between the poly(acrylic acid) existing at the top surfaces of the Zn.Ph coated electrogalvanized steel and the polyurethane, rather than with mechanical interlocking bonds caused by the anchoring effects of the polyurethane film penetrating into rough crystal layers. Whatever the mechanism of bonding, FIG. 21 shows that elctrogalvanized steel surfaces exhibiting significantly improved bond strength at the metal/polymer topcoat Joints can be prepared by immersing the electrogalvanized steel surfaces for about 30 seconds in cobalt-nitrate-containing test zinc-phosphating solution at about 80° C.

To clarify the cause of good and poor interfacial bonds between polyurethane topcoat films and electrogalvanized steel, x-ray photoelectron spectroscopy was used to explore failure surfaces. The results of the x-ray photoelectron spectroscopy analysis is set forth in Table 9 below.

TABLE 9

Chemical Composition of the Failed Side for PU/EGS, PU/Co-modified-Zn.Ph coated EGS, and PU/Zn.Ph EGS Joint Systems

| | | Atomic Concentration, % | | | | |
|---|---|---|---|---|---|---|
| Joint system | Failed side | Si | P | C | O | Zn |
| PU/EGS | PU | 18.7 | — | 61.1 | 20.2 | — |
| PU/EGS | EGS | 0.5 | — | 45.6 | 40.4 | 13.5 |
| PU/Co—Zn.Ph | PU | 20.0 | — | 59.6 | 20.4 | — |
| PU/Zn.Ph | Co—Zn.Ph | 12.0 | 8.1 | 49.5 | 29.0 | 1.4 |
| PU/Zn.Ph | PU | 17.1 | — | 61.9 | 21.0 | — |
| PU/Zn.Ph | Zn.Ph | 3.8 | 0.3 | 45.1 | 47.2 | 3.6 |

PU = polyurethane topcoat film
EGS = electrogalvanized steel
Co—Zn.Ph = Coating from 30 second immersion in cobalt-nitrate containing test solution.
Zn.Ph = Coating from 30 second immersion in control solution.

Table 9 presents the elemental compositions for cross-section samples of polyurethane/electrocoated steel, polyurethane-treated Co—Zn.Ph and polyurethane-treated Zn.Ph joint systems. The treated surfaces of electrogalvanized steel were immersed for about 30seconds in either the cobalt-nitrate containing test zinc-phosphating solution or the reference zinc-phosphating solution. In the polyurethane/untreated electrogalvanized-steel Joint systems, the chemical constituents of the polyurethane and electrogalvanized sides of the interface were generally similar to those of the bulk polyurethane (not shown) and the original electrogalvanized steel, although exiguous silicon atoms, revealing the $SiC_2$ used as a filler of the polyurethane topcoat film, eividently migrated from the polyurethane to the electrogalvanized steel. The data for the polyurethane untreated electrogalvanized steel Joint system suggested that failure occured at the interface between the polyurethane and the electrogalvanized steel. It is apparent that such an adhesive failure mode reflects the formation of a weak boundary structure at the interface, and a low rate of development of interfacial bonds.

There were substantial differences between the finding for the polyurethane/untreated-electrogalvanized-steel joint system and that from the polyurethane cobalt-modified-Zn.Ph-coated-electrogalvanized-steel Joint system. Specifically, a large amount of silicon and little oxygen and zinc was detected on the cobalt-modified Zn.Ph coating side removed from the polyurethane film. Essentially no phosphorous or zinc was present on the polyurethane side. Thus, failure appeared to be a cohesive mode which occurred through the polyurethane layers. Such a failure mode by a favorable affinity of polyurethane with the cobalt-modified Zn.Ph coating implied that the strength of the interfacial bond structure was significantly greater than that of polyurethane itself. In contrast, in the case of the polyurethane/unmodified Zn-Ph coating-electrogalvanized-steel Joint system, some ellicon evidently adhered to the Zn.Ph side, while there was a relatively low concentration of zinc at the Zn.Ph side and essentially no phosphorous or zinc at the polyurethane side. Consequently, a similar failure mode to that of polyurethane/cobalt-modified-Zn.Ph-coated-electrogalvanized-steel Joint system might have occurred: bond breaksage might have started through the polyurethane layer close to the metal substrates. Considering the absence of Zn.Ph crystals, a major factor governing the development of interfacial bonds may be the chemical reaction between the polyurethane and the poly(acrylic acid) absorbed on electrogalvanized steel.

Upon reading the subject application various alternative embodiments will become obvious to those skilled in the art. These embodiments are to be considered within the scope and spirit of the subject invention. This invention is only to be limited by the claims which follow and their equivalents.

I claim:

1. A method of coating an electrogalvanized steel base, which comprises contacting the base with a composition containing (i) aqueous zinc phosphate, (ii) a transition-metal compound promoter selected from the group consisting of a manganese, iron, cobalt, nickel or copper compound, (iii) a polyelectrolyte selected from the group consisting of polyacrylic acid, polymethacrylic acid, polyitaconic acid and poly-L-glutamic acid, said polyelectrolyte being present from about 0.5 to 5.0% by weight of the total composition, and (iv) a source of Fe ions.

2. A method of claim 1 in which the transition-metal compound promoter comprises a cobalt or nickel compound.

3. A method of claim 2, wherein the cobalt or nickel in the compound, or mixture thereof, is present at a concentration of from about 0.1% to about 0.4% by weight of the total composition.

4. A method of claim 2, wherein the cobalt or nickel compound, or mixture thereof, comprises a carbonate or nitrate.

5. A method of claim 4, wherein the cobalt or nickel compound, or mixture thereof, comprises $Co(No_3)_2.6H_2O$ or $Ni(No_3)_2.6H_2O$.

6. A method of claim 5, wherein the $Co(No_3)_2.6H_2O$ or $Ni(No_3)_2.6H_2O$ is present at a concentration of from about 0.5% to about 2.0% by weight of the total composition.

7. A method of claim 1, wherein the molecular weight of the electrolyte is from about 5,000 to about 100,000.

8. A method of claim 1 further comprising heating the metal surface following the contacting of the base with the composition.

9. A method of claim 8, wherein the heating is sufficient to convert hydrous zinc phosphate to its α-phase anhydrous form.

10. A method of claim 8, wherein the heating is to a temperature of from about 300° C. to about 350° C. for a period of about two hours.

11. A method of claim 1, wherein the Fe ions are present at a concentration of from about 2.4 to about 5.6 ppm.

12. The method of claim 1, wherein said contacting is performed by dipping from about 2 seconds to about 10 seconds.

13. The method of claim 1, wherein said contacting is performed at a temperature from about 80° C. to about 90° C.

14. A zinc phosphate conversion composition comprising zinc phosphate, water, a transition-metal-compound promoter selected from the group consisting of a manganese, iron, cobalt, nickel or copper compound, a polyelectrolyte selected from the group consisting of polyacrylic acid, polymethacrylic acid, polyitaconic acid and poly-L-glutamic acid, said polyelectrolyte being present from about 0.5% by weight to about 5.0% by weight of the total composition, and a source of Fe ions.

15. A zinc phosphate conversion composition of claim 14 in which the transition-metal-compound promoter comprises a cobalt or nickel compounds.

16. A composition of claim 14 which comprises from about 0.3 to about 5.0 wt % $Zn_3(PO_4)_2.2H_2O$, from about 0.6 to about 10.0 wt % $H_3PO_4$, from about 99.1 to about 85.0 wt % water, from about 0.5 to about 2.0 wt % $Ni(NO_3)_2.6H_2O$ or $Co(NO_3)_2.6H_2O$ or mixtures thereof, a polyelectrolyte selected from the group consisting of polyacrylic acid, polymethacrylic acid, polyitaconic acid and poly-L-glutamic acid, and Fe ions at a concentration of from about 2.4 to about 5.6 ppm.

17. A composition of claim 14, wherein the polyelectrolyte is polyitaconic acid or poly-L-glutamic acid.

18. A composition of claim 14, wherein the Fe ions are present at a concentration of from about 2.4 to about 5.6 ppm.

19. The zinc phosphate conversion composition of claim 14 used for coating an electrogalvanized steel base.

20. A method of coating an electrogalvanized steel base, which comprises contacting the base with a composition containing (i) aqueous zinc phosphate, (ii) a transition-metal-compound promoter comprising a manganese, iron, cobalt, nickel or copper compound, (iii) a polyelectrolyte selected from the group consisting of polyacrylic acid, polymethacrylic acid, polyitaconic acid and poly-L-glutamic acid, said polyelectrolyte being present from about 0.5 to 5.0% by weight of the total composition, and (iv) a source of Fe ions, said Fe ions being present in an amount from about 2.4 ppm to about 5.6 ppm.

21. A zinc phosphate conversion composition comprising zinc phosphate, water, a transition-metal-compound promoter comprising a manganese, iron, cobalt, nickel or copper compound, a polyelectrolyte selected from the group consisting of polyacrylic acid, polymethacrylic acid, polyitaconic acid and poly-L-glutamic acid, said polyelectrolyte being present from about 0.5 to 5.0% by weight of the total composition, and a source of Fe ions, said Fe ions being present in an amount from about 2.4 ppm to about 5.6 ppm.

22. A laminar structure comprising a metallic substrate bearing a zinc-phosphate coating composition produced by the method of claim 1.

23. A laminar structure comprising a metallic substrate bearing a zinc-phosphate coating composition which comprises zinc-phosphate, water, a transition-metal-compound promoter selected from the group consisting of a manganese, iron, cobalt, nickel or copper compound, a polyelectrolyte selected from the group consisting of a polyacrylic acid, polymethacrylic acid, polyitaconic acid and poly-L-glutonic acid, said polyelectrolyte being present from about 0.5% by weight to about 5.0% by weight of the total composition, and a source of Fe ions.

24. The laminar structure of claim 23 in which the metallic substrate is electrogalvanized steel.

25. A laminar structure of claim 24 further comprising a polymeric film overlaying the zinc-phosphate coating composition.

26. A laminar structure of claim 25 in which the polymeric film is a polyurethane film.

* * * * *